US010826209B2

(12) United States Patent
Fang et al.

(10) Patent No.: US 10,826,209 B2
(45) Date of Patent: Nov. 3, 2020

(54) BUCKLE MEMBER AND ASSEMBLY DEVICE HAVING SAME

(71) Applicant: LOTES CO., LTD, Keelung (TW)

(72) Inventors: Fei Long Fang, Keelung (TW); You Hua Cai, Keelung (TW); Hua Jiang, Keelung (TW); Zhi Jie Li, Keelung (TW); Jia Xu Yin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/661,031

(22) Filed: Oct. 23, 2019

(65) Prior Publication Data

US 2020/0127397 A1 Apr. 23, 2020

(30) Foreign Application Priority Data

Oct. 23, 2018 (CN) ..... 2018 1 1232830
Feb. 1, 2019 (CN) ..... 2019 1 0104039
Aug. 28, 2019 (CN) ..... 2019 1 0804467

(51) Int. Cl.
*H01R 12/70* (2011.01)
*H01R 12/73* (2011.01)

(52) U.S. Cl.
CPC ..... *H01R 12/7023* (2013.01); *H01R 12/737* (2013.01)

(58) Field of Classification Search
CPC ..... H01R 12/7023; H01R 12/7029; H01R 12/737; H01R 12/72; H05K 3/366
USPC ..... 439/567, 59
See application file for complete search history.

(56) References Cited

U.S. PATENT DOCUMENTS 5,336,111 A * 8/1994 Thrush ..... H01R 12/7064 439/567
6,471,544 B1 10/2002 Huang
6,540,553 B1 * 4/2003 Wu ..... H01R 12/7029 439/567
7,052,317 B2 * 5/2006 Hara ..... H01R 12/7029 439/567

(Continued)

FOREIGN PATENT DOCUMENTS

CN 102918943 B 7/2014
CN 205621904 U 10/2016

(Continued)

*Primary Examiner* — Hien D Vu
(74) *Attorney, Agent, or Firm* — Locke Lord LLP; Tim Tingkang Xia, Esq.

(57) ABSTRACT

An assembly device includes a first device and a second device. The first device is provided with a mounting slot. The second device has a through hole penetrating vertically therethrough. A buckle member is correspondingly accommodated in the mounting slot, and includes a base, a connecting leg extending downward from the base, and an extending portion extending obliquely downward from the base. The mounting slot is provided with a position limiting portion to stop the buckle member from being detached downward from the mounting slot. The connecting leg is inserted downward into the through hole, and is provided with a buckle portion extending in a lateral direction. The extending portion and the buckle portion are located at the same side of the connecting leg. The second device upward abuts the extending portion to drive the buckle portion to swing outward from the through hole.

11 Claims, 30 Drawing Sheets

(56) References Cited

U.S. PATENT DOCUMENTS 7,081,014 B2 * 7/2006 Pan ..... H01R 12/7052
439/567
7,611,381 B2 * 11/2009 Lei ..... H01R 12/716
439/567

FOREIGN PATENT DOCUMENTS

CN 205752850 U 11/2016
TW 339883 U 9/1998

* cited by examiner

E-E

G-G

BUCKLE MEMBER AND ASSEMBLY DEVICE HAVING SAME

CROSS-REFERENCE TO RELATED PATENT APPLICATION

This non-provisional application claims priority to and the benefit of, pursuant to 35 U.S.C. § 119(a), patent application Serial No. CN201811232830.1 filed in China on Oct. 23, 2018, patent application Serial No. CN201910104039.0 filed in China on Feb. 1, 2019, and patent application Serial No. CN201910804467.4 filed in China on Aug. 28, 2019. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an assembly device, and more particularly to an assembly device in which an electrical connector is mated with a circuit board by a buckle member.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional fixing structure of a connector is used for fixing the connector to a circuit substrate, and includes multiple fixing clamps. Each fixing clamp has a fixing end which is insertable to a bottom surface of the connector, and two fastening sheets which respectively extend downward from the fixing end. An arc-shaped engaging end protrudes outward from the bottom of each of the fastening sheets. The two fastening sheets are inserted into an insertion hole of the circuit substrate, and a bottom edge of the insertion hole is engaged by the engaging ends thereof, thereby connecting a connector body to the circuit substrate.

In the process of the fixing clamps of such structure buckling a circuit board, when the engaging end is subject to an excessive downward force, the engaging end is easily detached from the bottom edge of the insertion hole, thereby causing the fastening sheet to be detached from the circuit substrate, resulting in separation of the connector from the circuit substrate, and affecting the buckle effect.

Therefore, a heretofore unaddressed need to design a novel assembly device exists in the art to address the aforementioned deficiencies and inadequacies.

SUMMARY

In view of the problems in the background, the present invention is directed to an assembly device in which a buckle member can effectively connect a first device and a second device.

In order to achieve the foregoing objective, the present invention adopts the following technical solutions:

An assembly device includes: a first device, provided with a mounting slot penetrating through a bottom of the first device, wherein the mounting slot is provided with a position limiting portion; a second device, having a through hole penetrating vertically therethrough, wherein the second device is provided below the first device, and a gap is formed between the second device and the bottom of the first device in a vertical direction; and a buckle member, configured to connect the first device and the second device, wherein the buckle member is correspondingly accommodated in the mounting slot, and the buckle member includes: a base, provided in the mounting slot; a connecting leg extending downward from the base, wherein the connecting leg is inserted downward into the through hole and is provided with a buckle portion extending in a lateral direction outward from the through hole; and an extending portion, provided in the gap and formed by extending obliquely downward from the base, wherein the extending portion and the buckle portion are located at a same side of the connecting leg in the lateral direction. The position limiting portion is configured to stop the buckle member from being detached downward from the mounting slot, and the second device upward abuts the extending portion to drive the buckle portion to swing outward from the through hole, such that the second device is located above the buckle portion to stop the buckle portion from moving upward.

In certain embodiments, the base includes a supporting portion located above the position limiting portion, the supporting portion is configured to downward abut the position limiting portion before the buckle member is connected to the second device, so as to prevent the buckle member from being detached downward from the mounting slot, and the extending portion and the supporting portion are respectively provided at an upper side and a lower side of the position limiting portion.

In certain embodiments, the supporting portion is detached from the position limiting portion after the buckle member is connected to the second device, and is provided separately from the position limiting portion.

In certain embodiments, the buckle portion is provided with a first abutting point configured to abut the second device, the extending portion is provided with a second abutting point configured to abut the second device, the base is provided with a third abutting point configured to abut a slot wall of the mounting slot, and the first abutting point is located between the second abutting point and the third abutting point in the lateral direction.

In certain embodiments, the base is provided with a fourth abutting point configured to abut the position limiting portion, and the fourth abutting point is located between the first abutting point and the second abutting point in the lateral direction.

In certain embodiments, the slot wall of the mounting slot is provided with a stopping portion, the base comprises a body portion and a protruding portion extending from the body portion, the extending portion is formed by extending from the body portion, the protruding portion and the extending portion are respectively located at two opposite sides of the body portion in the lateral direction, and the protruding portion is stopped by the stopping portion in the lateral direction.

In certain embodiments, the protruding portion is formed by extending upward from the body portion, the extending portion is formed by extending from the body portion in the lateral direction toward a direction away from the protruding portion, and an included angle formed between an extending direction of the protruding portion and an extending direction of the extending portion is an obtuse angle.

In certain embodiments, the base includes a connecting portion and a supporting portion, the connecting portion extends upward from the body portion and then bends downward to be connected to the supporting portion, the supporting portion is located above the position limiting portion and is limited by the position limiting portion to prevent the buckle member from being detached downward from the mounting slot, and the supporting portion and the protruding portion are respectively provided at two sides of the connecting portion.

In certain embodiments, the stopping portion abuts the protruding portion such that an abutting position of the extending portion and the second device moves in the lateral direction toward a direction away from the corresponding through hole.

In certain embodiments, the buckle portion is provided to extend obliquely downward from the connecting leg, an included angle between the connecting leg and the buckle portion is an obtuse angle, the buckle portion is provided with a plurality of protrusions along an extending direction of the buckle portion, and a joint between a bottom of the second device and the through hole is engaged with one of the protrusions.

In certain embodiments, the assembly device includes two buckle members, the first device is provided with two adjacent mounting slots and a partition barrier separating the two adjacent mounting slots, each of the mounting slots accommodates one of the two buckle members, the buckle members in the adjacent mounting slots are inserted into the same through hole, and the extending portions of the two buckle members inserted into the same through hole extend toward opposite directions in the lateral direction.

In certain embodiments, each of the buckle members is provided with a strip connecting portion at a lower end of the buckle portion thereof, and the strip connecting portions of the two adjacent buckle members are configured to be connected to a same strip.

Compared with the related art, in certain embodiments of the present invention, the buckle member is provided with the extending portion between the bottom of the first device and the second device, and the mounting slot is provided with the position limiting portion to stop the buckle member from being detached downward from the mounting slot. That is, the first device cannot be detached upward from the buckle member, such that the base is mounted to the mounting slot, and the through hole is sleeved outside the connecting leg until the second device upward abuts the extending portion. Since the extending portion extends obliquely downward from the base, there is necessarily an included angle between the extending portion and the bottom of the first device. The included angle may be reduced due to an upward abutting force applied to the extending portion by the second device, so as to drive the connecting leg to swing outward from the through hole. Since the extending portion and the buckle portion are located at the same side of the connecting leg in the lateral direction, the buckle portion can move synchronously with the extending portion, such that the bottom of the second device is located above the buckle portion to stop the buckle portion from moving upward. That is, the buckle portion may be used for stopping the second device from moving downward. It can be seen that the upward abutting force applied to the extending portion by the second device may effectively ensure the buckle member to be capable of rotationally swinging, thus providing the buckle portion below the bottom of the second device to stop the second device from moving downward. The first device cannot be detached upward from the buckle member, thereby ensuring a tight connection between the first device and the second device.

The present invention is also directed to an assembly device in which a first device may be fastened to a second device by a buckle member.

In order to achieve the foregoing objective, the present invention adopts the following technical solutions:

An assembly device includes: a first device, provided with at least one mounting slot, wherein each of the at least one mounting slot is provided with a bearing portion; a second device, having a top surface and a bottom surface provided opposite to each other, and at least one through hole penetrating vertically therethrough; and at least one buckle member, configured to connect the first device and the second device, and correspondingly accommodated in the at least one mounting slot, wherein each of the at least one buckle member has a base provided in the mounting slot, the base is provided with a supporting portion supported by the bearing portion and forming a pivot point with the bearing portion, the base extends downward to form a connecting leg, the connecting leg protrudes downward out of the first device and is accommodated in the through hole, the connecting leg protrudes toward the pivot point to form a buckle portion, the buckle portion is fastened on the bottom surface to form a buckle point between the buckle portion and the bottom surface, the pivot point is provided farther away from the corresponding through hole than the buckle point in a lateral direction, the supporting portion and the bearing portion are in a moving fit, and the buckle portion is subject to a downward force by the second device, such that the buckle portion swings outward from the through hole in the lateral direction around the pivot point.

In certain embodiments, the supporting portion downward abuts the bearing portion to limit the buckle member from being detached downward from the first device, the mounting slot is provided with a position limiting portion, the base is provided with an elastic sheet, and the position limiting portion is located above the elastic sheet and limits the buckle member from being detached upward from the first device.

In certain embodiments, the buckle member is assembled upward into the mounting slot, the mounting slot is provided with a position limiting portion, the base is provided with a stop portion, and the position limiting portion is provided above the stop portion to limit the buckle member from moving excessively upward.

In certain embodiments, the assembly device includes two buckle members, the first device is provided with two adjacent mounting slots and a partition barrier separating the two adjacent mounting slots, each of the mounting slots accommodates one of the two buckle members, each of the buckle members is provided with a strip connecting portion at a lower end of the base, and the strip connecting portions of the two adjacent buckle members are connected to a same strip.

In certain embodiments, the assembly device includes two buckle members, the first device is provided with two adjacent mounting slots and a partition barrier separating the two adjacent mounting slots, each of the mounting slots accommodates one of the two buckle members, and the connecting legs of the two adjacent buckle members are accommodated in the same through hole.

In certain embodiments, the first device has an insertion slot for insertion of a mating member, the insertion slot extends along a lengthwise direction, the first device has the at least one mounting slot in at least one end of the insertion slot, the first device has a mounting portion on at least one end of the insertion slot, the mounting portion has two side walls provided opposite to each other and an end wall connecting the two side walls, the end wall and the insertion slot are provided separately in the lengthwise direction and an accommodating slot is formed between the end wall and the insertion slot, the first device further comprises an ear clip accommodated in the accommodating slot to latch the mating member, and at least a portion of the mounting slot is provided on the end wall.

Compared with the related art, the assembly device according to certain embodiments of the present invention have the following beneficial effects.

In the present invention, the buckle member is rotatable relative to the first device by a loose fit between the buckle member and the first device, and the pivot point is provided away from the corresponding through hole than the buckle point in the lateral direction. When the buckle member is subject to a large downward force by the second device, the buckle portion is subject to the force to swing outward from the through hole in the lateral direction around the pivot point. That is, the buckle point moves toward the pivot point in the lateral direction, such that the buckle portion fastens the bottom surface of the second device, thereby firmly buckling the second device, and ensuring the buckle effect.

The present invention is further directed to a buckle member by which a first device may be fastened to a second device.

In order to achieve the foregoing objective, the present invention adopts the following technical solutions:

A buckle member is configured to buckle a first device and a second device. The first device is provided with a mounting slot, the mounting slot is provided with a bearing portion. The second device has a top surface, a bottom surface and a through hole penetrating the top surface and the bottom surface. The buckle member includes: a base, accommodated in the mounting slot, wherein the base is provided with a supporting portion supported by the bearing portion and forming a pivot point with the bearing portion, the base is provided with a strip connecting portion at an inner side of the pivot point, and the strip connecting portion is provided at a lower end of the base and located below the pivot point; a connecting leg, extending downward from the base and accommodated in the through hole; and a buckle portion, formed by protruding from the connecting leg, wherein the buckle portion is fastened on the bottom surface to form a buckle point between the buckle portion and the bottom surface, the pivot point is located at an outer side of the through hole with respect to the buckle point in a lateral direction, the supporting portion and the bearing portion are in a moving fit, and the buckle portion is subject to a downward force by the second device, such that the buckle portion swings outward from the through hole in the lateral direction around the pivot point.

In certain embodiments, the base includes an extending portion extending upward from the connecting leg, a connecting portion extending upward from the extending portion, and the supporting portion formed by extending downward from an upper end of the connecting portion, and the connecting portion is deviated from the connecting leg in the lateral direction.

Compared with the related art, the assembly device according to certain embodiments of the present invention have the following beneficial effects.

In the present invention, the buckle member is rotatable relative to the first device by a loose fit between the buckle member and the first device, and the pivot point is provided on the outer side of the through hole with respect to the buckle point in the lateral direction. When the buckle member is subject to a large downward force by the second device, the buckle portion is subject to the force to swing outward from the through hole in the lateral direction around the pivot point. That is, the buckle point moves toward the pivot point in the lateral direction, such that the buckle portion fastens the bottom surface of the second device, thereby firmly buckling the second device, and ensuring the buckle effect.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Unless otherwise stated, the same reference numbers are used throughout the drawings to refer to the same or like elements of an embodiment, and wherein.

DETAILED DESCRIPTION

Figure 1:
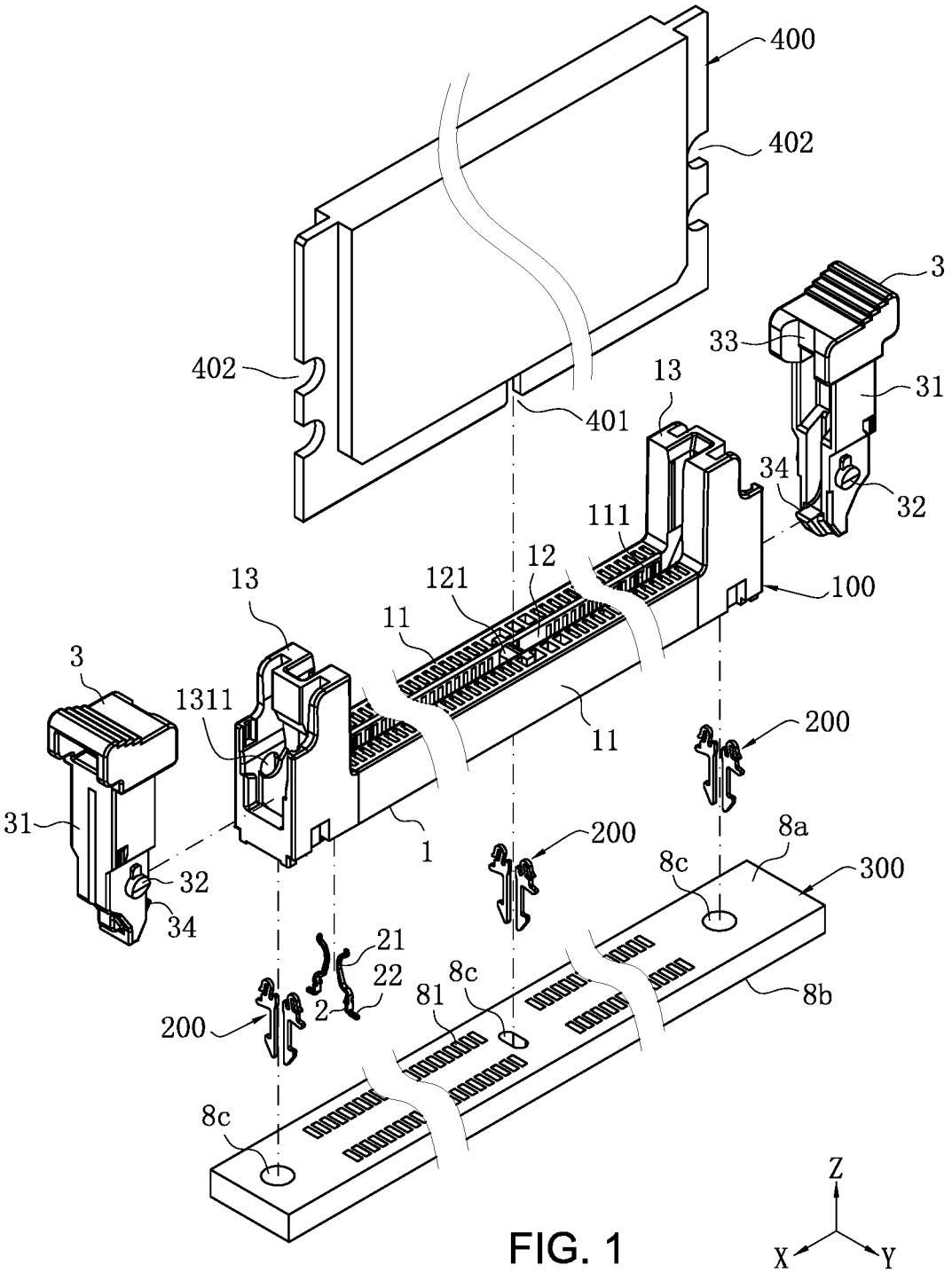
FIG. 1 is an exploded view of an assembly device according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, unless otherwise stated, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated. As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-30. In accordance with the purposes of this invention, as embodied and broadly described herein, this invention, in one aspect, relates to an assembly device.

Figure 4:
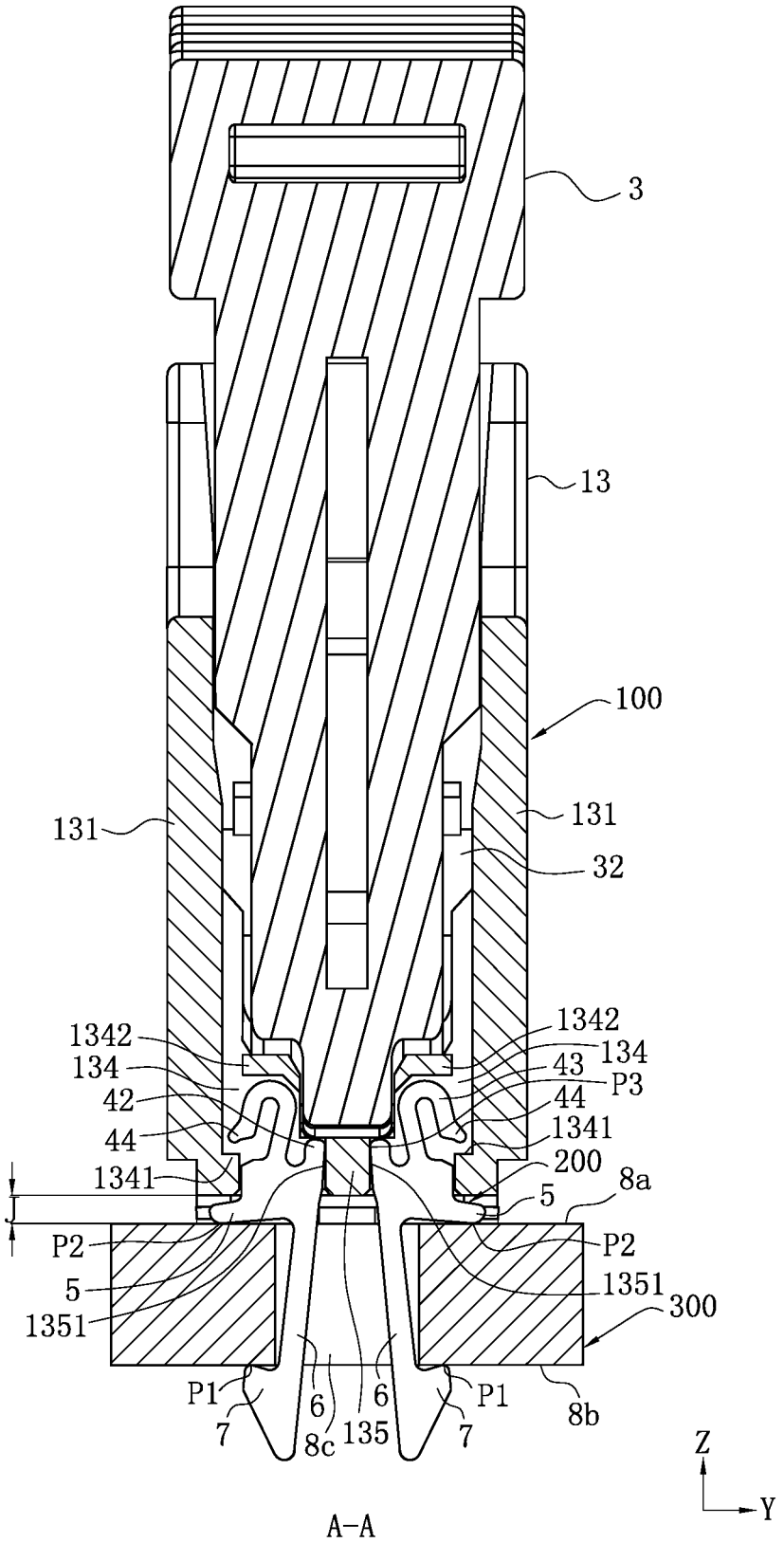
FIG. 4 is a sectional view in FIG. 2 along an A-A direction.

As shown in FIG. 1 and FIG. 4, an assembly device according to a first embodiment of the present invention includes a first device, at least one buckle member 200 and a second device. The buckle member 200 buckles the first device and the second device together. In the present embodiment, the first device is an electrical connector 100, the second device is a circuit board 300, and multiple buckle members 200 are provided to buckle the electrical connector 100 to the circuit board 300. In other embodiments, the first device and the second device may be non-electrical components.

Figure 2:
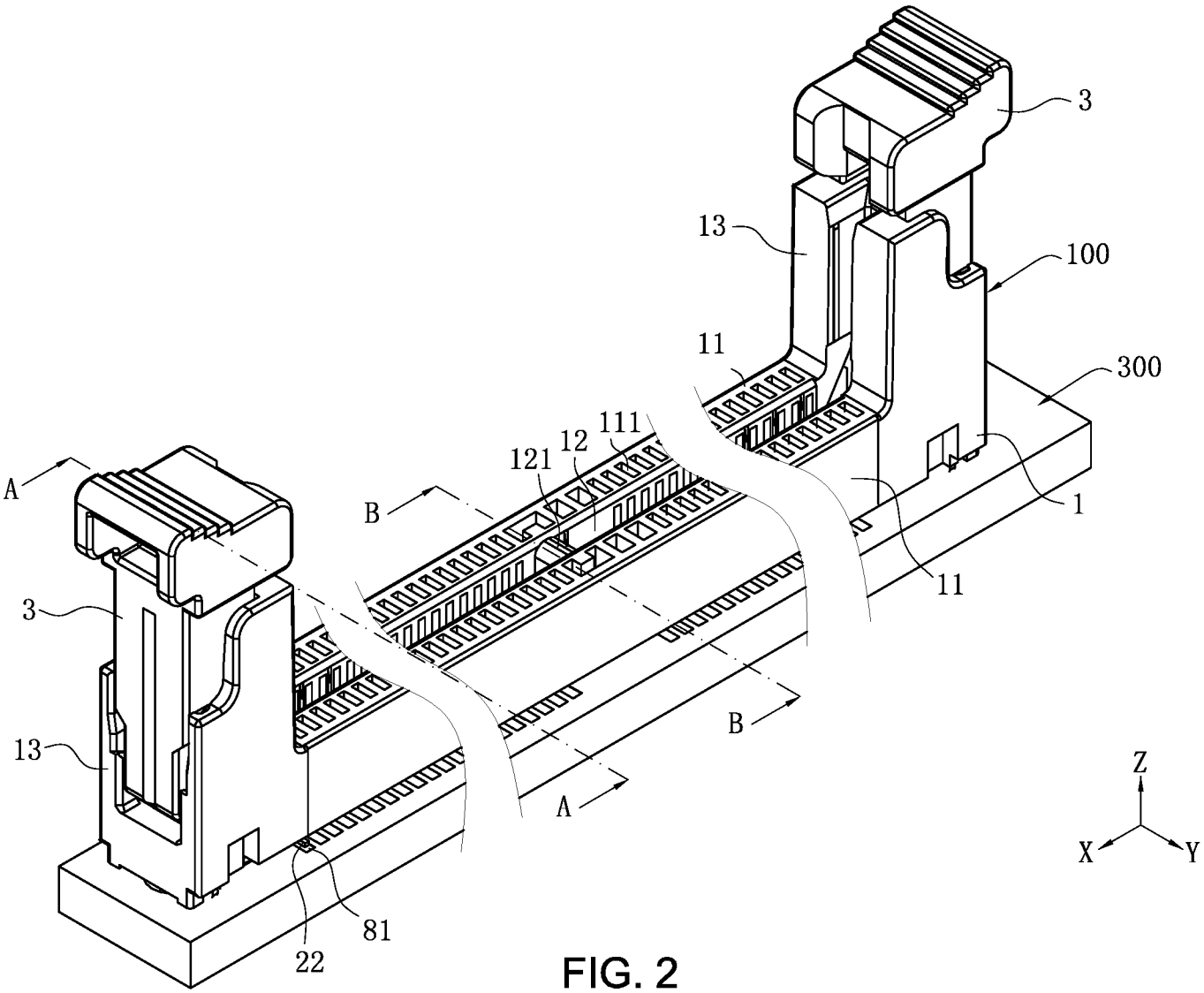
FIG. 2 is an assembled view of FIG. 1.

As shown in FIG. 1 and FIG. 2, the electrical connector 100 is a Double Data Rate (DDR) connector, and includes an insulating body 1, multiple terminals 2 provided in the insulating body 1, and two ear clips 3 pivoted to two opposite ends of the insulating body 1. The electrical connector 100 defines a lengthwise direction X, a lateral direction Y and a vertical direction Z, where the lengthwise direction X, the lateral direction Y and the vertical direction Z are perpendicular to each other pairwise.

As shown in FIG. 1 and FIG. 2, the insulating body 1 is provided with two lateral walls 11, an insertion slot 12 located between the two lateral walls 11 for insertion of an electronic card 400 therein, and a foolproof portion 121 provided in the insertion slot 12. The insertion slot 12 extends along the lengthwise direction X. The foolproof portion 121 is connected to the two lateral walls 11 along the lateral direction Y. The foolproof portion 121 divides the insertion slot 12 into two portions asymmetrically. The foolproof portion 121 is used to mate with an opening 401 of the electronic card 400 to prevent the electronic card 400 from being inserted into the insertion slot 12 backward. Each of the lateral walls 11 is provided with multiple accommodating slots 111.

Figure 5:
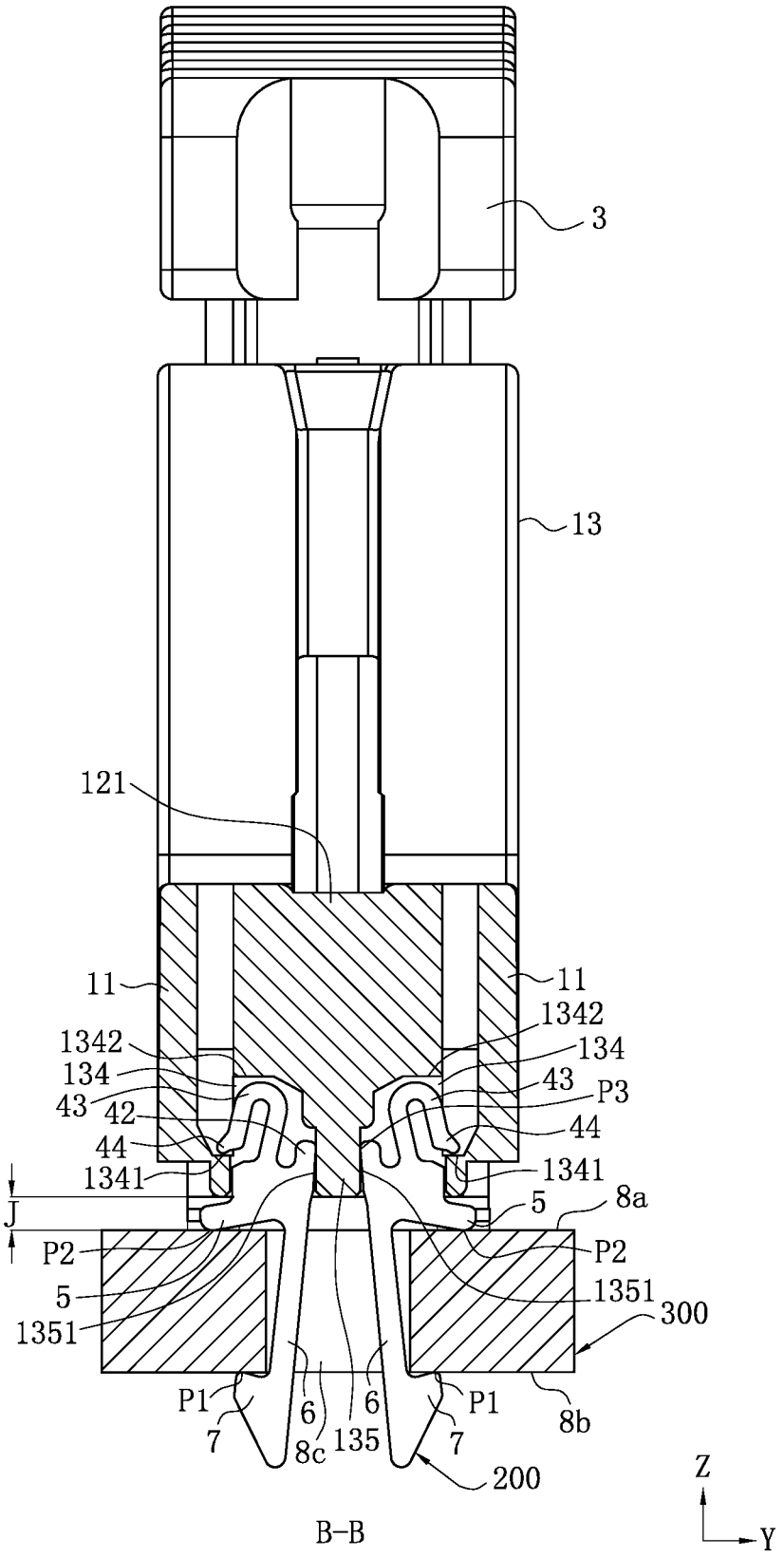
FIG. 5 is a sectional view in FIG. 2 along a B-B direction.

As shown in FIG. 1, FIG. 4 and FIG. 5, the terminals 2 are correspondingly received in the multiple accommodating slots 111. Each of the terminals 2 is provided with a contact portion 21 exposed in the insertion slot 12 to be in contact with the electronic card 400, and a conducting portion 22 exposed in the bottom of the insulating body 1 to be conductively connected with the circuit board 300.

Figure 3:
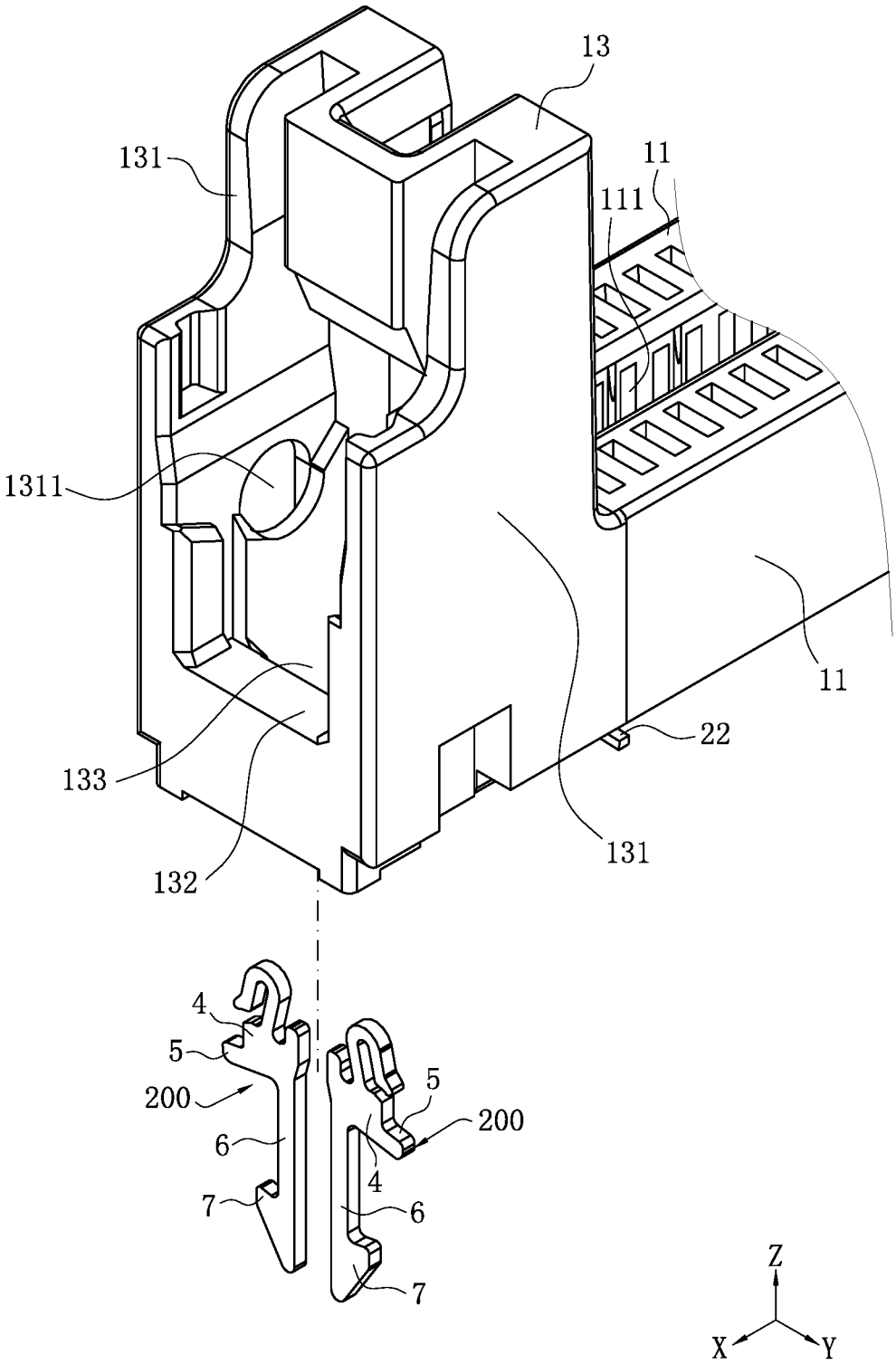
FIG. 3 is a partially enlarged view of FIG. 1.

As shown in FIG. 1 and FIG. 3, the insulating body 1 is provided with two mounting portions 13 at both ends of the insertion slot 12 respectively. Each mounting portion 13 has two side walls 131 provided opposite to each other and an end wall 132 connecting the two side walls 131. Each of the side walls 131 extends along the lengthwise direction X. The end wall 132 of each mounting portion 13 and the insertion slot 12 are spaced apart in the lengthwise direction X, and a receiving slot 133 is formed therebetween. Each of the receiving slots 133 receives one ear clip 3. Each of the side walls 131 is provided with a pivoting hole 1311.

As shown in FIG. 1 and FIG. 2, each of the ear clips 3 has a main body portion 31 and rotating shafts 32 provided at two opposite sides of the main body portion 31. The rotating shafts 32 are mounted in the corresponding pivoting holes 1311, such that the ear clip 3 is rotatable around the rotating shafts 32. Each ear clip 3 has a latching portion 33 located at an upper end of the main body portion 31 to latch with a notch 402 of the electronic card 400. An ejecting portion 34 is provided at a lower end of the main body portion 31. The ejecting portion 34 extends to the insertion slot 12 in the lengthwise direction X to push the electronic card 400 upward, such that the electronic card 400 is detached from the insertion slot 12.

As shown in FIG. 1, FIG. 4 and FIG. 5, two mounting slots 134 are provided at each of the bottom of each of the mounting portions 13 and the bottom of the foolproof portion 121 respectively. The two mounting slots 134 corresponding to each mounting portion 13 or the foolproof portion 121 are provided adjacent to each other at an interval in the lateral direction Y, and a partition barrier 135 is provided therebetween. The two adjacent mounting slots 134 are provided mirror-symmetrically with respect to the corresponding partition barrier 135. Each of the mounting slots 134 is correspondingly provided with one buckle member 200. The two buckle members 200 provided in the two adjacent mounting slots 134 are provided mirror-symmetrically with respect to the partition barrier 135. Each of the side surfaces of the partition barrier 135 facing the two adjacent mounting slots 134 is a slot wall (not labeled) at one side of the two adjacent mounting slots 134, and the slot wall is provided with a stopping portion 1351 to stop the corresponding buckle member 200 from moving toward the adjacent mounting slots 134 in the lateral direction Y. Each of the mounting slots 134 is extendedly provided with a position limiting portion 1341 toward the partition barrier 135 in the lateral direction Y. The position limiting portion 1341 is used to stop the buckle member 200 from moving downward in the vertical direction Z. Each position limiting portion 1341 located on the mounting portion 13 is provided at a bottom end of the corresponding side wall 131, and each position limiting portion 1341 located on the foolproof portion 121 is provided at a bottom end of the corresponding lateral wall 11. In the present embodiment, each position limiting portion 1341 is a boss structure extending toward one side of the partition barrier 135 along the lateral direction Y. Each of the mounting slots 134 is provided with a blocking portion 1342 above the corresponding position limiting portion 1341 and the partition barrier 135. The blocking portion 1342 is provided between the corresponding position limiting portion 1341 and the partition barrier 135 in the lateral direction Y, and the blocking portion 1342 is used to block the buckle member 200 from moving upward excessively in the vertical direction Z. In the present embodiment, a portion of the mounting slot 134 on each mounting portion 13 is located on the end wall 132, and another portion thereof is located on the corresponding side wall 131.

As shown in FIG. 1, FIG. 4 and FIG. 5, the circuit board 300 has a top surface 8*a* and a bottom surface 8*b* provided opposite to each other, and multiple through holes 8*c* penetrating through the circuit board 300 vertically. The circuit board 300 is provided below the electrical connector 100. When the electrical connector 100 is mounted on the circuit board 300, four corners of the insulating body 1 abut the top surface 8*a*, and a gap J is formed between other positions of the bottom of the insulating body 1 and the top surface 8*a*. In the present embodiment, three through holes 8*c* are provided, and the three through holes 8*c* are correspondingly formed below the two mounting portions 13 and the foolproof portion 121, respectively. The top surface 8*a* is provided with multiple pads 81 conductively connected with the conducting portions 22.

Figure 6:
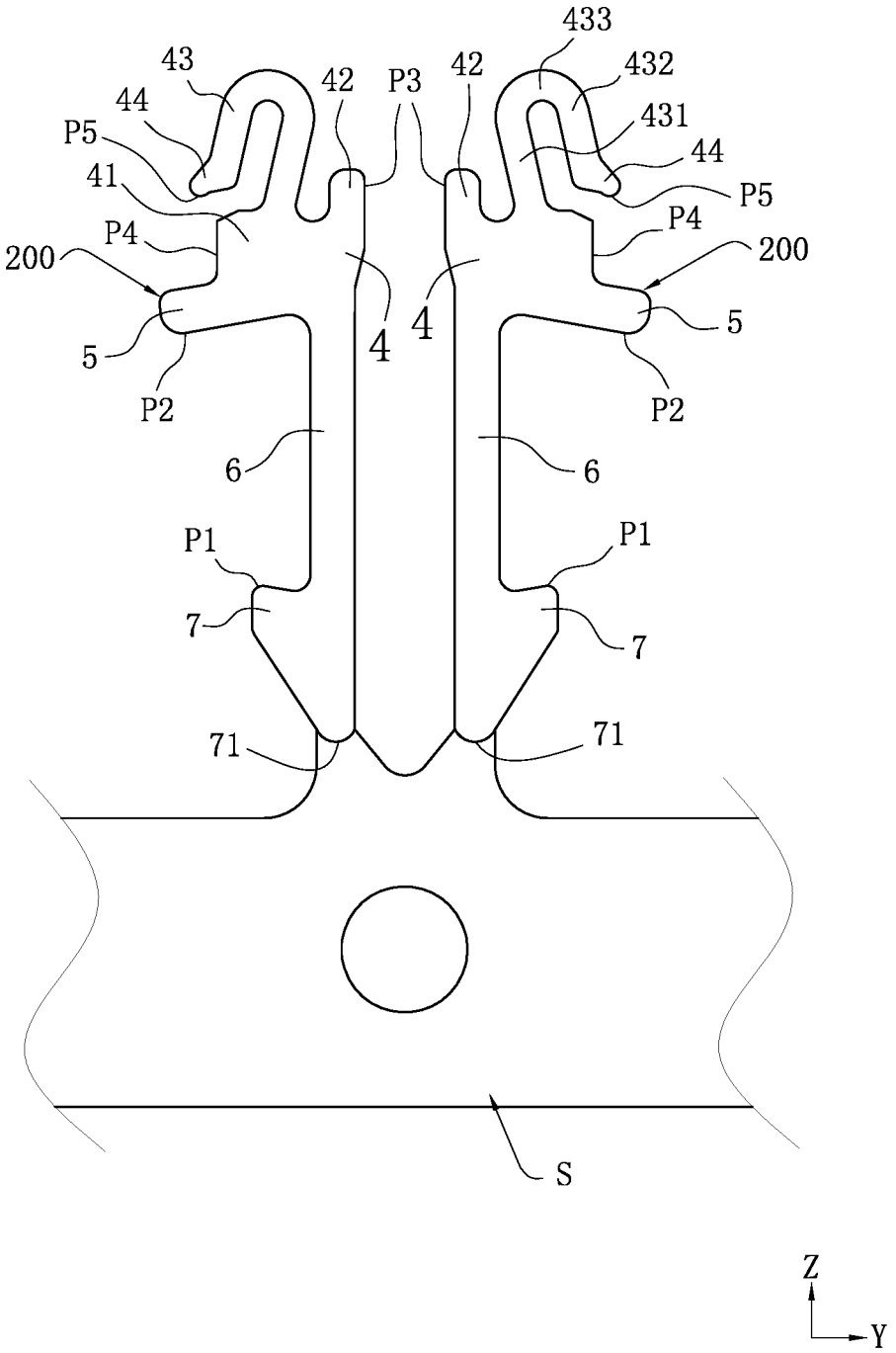
FIG. 6 is a schematic view of two adjacent buckle members in FIG. 1 before being disconnected from a strip.

As shown in FIG. 4, FIG. 5 and FIG. 6, each of the buckle members 200 is correspondingly mounted in one mounting slot 134 upward from bottom thereof. Each buckle member 200 is made of a metal plate, and includes a base 4, an extending portion 5 extending from the base 4, a connecting leg 6, and a buckle portion 7 extending outward from a tail end of the connecting leg 6. The base 4 is provided in the corresponding mounting slot 134, and is in loose fit with the corresponding mounting slot 134. The extending portion 5 extends downward along the lateral direction Y and obliquely toward a direction away from the corresponding partition barrier 135. The connecting leg 6 extends downward along the vertical direction Z. The buckle portion 7 extends upward along the lateral direction Y and obliquely toward a direction away from the corresponding partition barrier 135. The extending portion 5 and the buckle portion 7 are located at the same side of the connecting leg 6 in the lateral direction Y. An included angle between the extending portion 5 and the connecting leg 6 is an acute angle, and an included angle between the buckle portion 7 and the connecting leg 6 is an acute angle. It can be seen that the extending direction of the extending portion 5 and the extending direction of the buckle portion 7 intersect with each other at the same side of the connecting leg 6.

As shown in FIG. 4, FIG. 5 and FIG. 6, the connecting leg 6 is inserted downward into the through hole 8*c* along the vertical direction Z, and the two buckle members 200 in the two adjacent mounting slots 134 in the lateral direction Y are received in the same through hole 8*c*. The buckle portion 7 is provided below the bottom surface 8*b* and extends obliquely upward along the lateral direction Y, and the buckle portion 7 is provided with a first abutting point P1 to abut the bottom surface 8*b*. The buckle portion 7 is used to prevent the circuit board 300 from moving downward relative to the electrical connector 100 to be detached from the buckle member 200. The extending portion 5 extends obliquely downward along the lateral direction Y from the base 4 and is provided in the gap J. The extending portion 5 is provided with a second abutting point P2 abutting the top surface 8*a*. The second abutting point P2 is provided below the position limiting portion 1341 in the vertical direction Z. The extending portions 5 of the two buckle members 200 inserted into the same through hole 8*c* extend toward opposite directions in the lateral direction Y.

As shown in FIG. 6, a strip connecting portion 71 is provided at a lower end of the buckle portion 7 to connect a strip S, and the two buckle members 200 mounted in the two adjacent mounting slots 134 in the lateral direction Y connect the same strip S.

As shown in FIG. 4, FIG. 5 and FIG. 6, the base 4 includes a body portion 41, a protruding portion 42 extending from the body portion 41, a connecting portion 43 extending from the body portion 41, and a supporting portion 44 provided at a tail end of the connecting portion 43. The extending portion 5 extends obliquely downward along the lateral direction Y from the body portion 41. The connecting leg 6 extends obliquely downward along the vertical direction Z from the body portion 41. The protruding portion 42 extends upward along the vertical direction Z from the body portion 41. The connecting portion 43 extends obliquely upward along the vertical direction Z from the body portion 41. The protruding portion 42 and the connecting portion 43 are provided at an interval in the lateral direction Y. The protruding portion 42 and the extending portion 5 are located at two opposite sides of the body portion 41 in the lateral direction Y. The connecting portion 43 is connected to the body portion 41 between the protruding portion 42 and the extending portion 5, and an included angle formed between the extending direction of the protruding portion 42 and the extending direction of the extending portion 5 is an obtuse angle. The connecting portion 43 includes a first connecting portion 431, a second connecting portion 432, and a turning portion 433 connecting the first connecting portion 431 and the second connecting portion 432. The first connecting portion 431 extends obliquely upward along the vertical direction Z from the body portion 41. The second connecting portion 432 extends obliquely downward along the vertical direction Z from the turning portion 433. The first connecting portion 431 and the second connecting portion 432 are parallel to each other. The supporting portion 44 is provided at a tail end of the second connecting portion 432. The supporting portion 44 and the protruding portion 42 are provided at two sides of the first connecting portions 431 in the lateral direction Y respectively. The first connecting portion 431 extends obliquely upward toward a direction away from the extending portion 5 in the lateral direction Y from the body portion 41.

As shown in FIG. 4, FIG. 5 and FIG. 6, the protruding portion 42 is stopped by the stopping portion 1351 in the lateral direction Y, and is provided with a third abutting point P3 to abut the stopping portion 1351 to prevent the buckle member 200 from moving toward the adjacent mounting slot 134 in the lateral direction Y. The body portion 41 is provided between the position limiting portion 1341 and the stopping portion 1351 in the lateral direction Y. The body portion 41 is stopped by the stopping portion 1341 in the lateral direction Y, and is provided with a fourth abutting point P4 to abut the position limiting portion 1341 in the lateral direction Y to prevent the buckle member 200 from moving toward the partition barrier 135 in the lateral direction Y. The supporting portion 44 is provided above the position limiting portion 1341 and is provided with a fifth abutting point P5 to abut the position limiting portion 1341 to stop the electrical connector 100 from moving upward relative to the buckle member 200 in the vertical direction Z. Thus, the supporting portion 44 and the extending portion 5 are provided on upper and lower opposite sides of the position limiting portion 1341, and the supporting portion 44, the extending portion 5 and the buckle portion 7 are all provided at the same side of the connecting leg 6. The turning portion 433 is provided below the corresponding stopping portion 1351 to stop the buckle member 200 from moving upward in the vertical direction Z.

Figure 7:
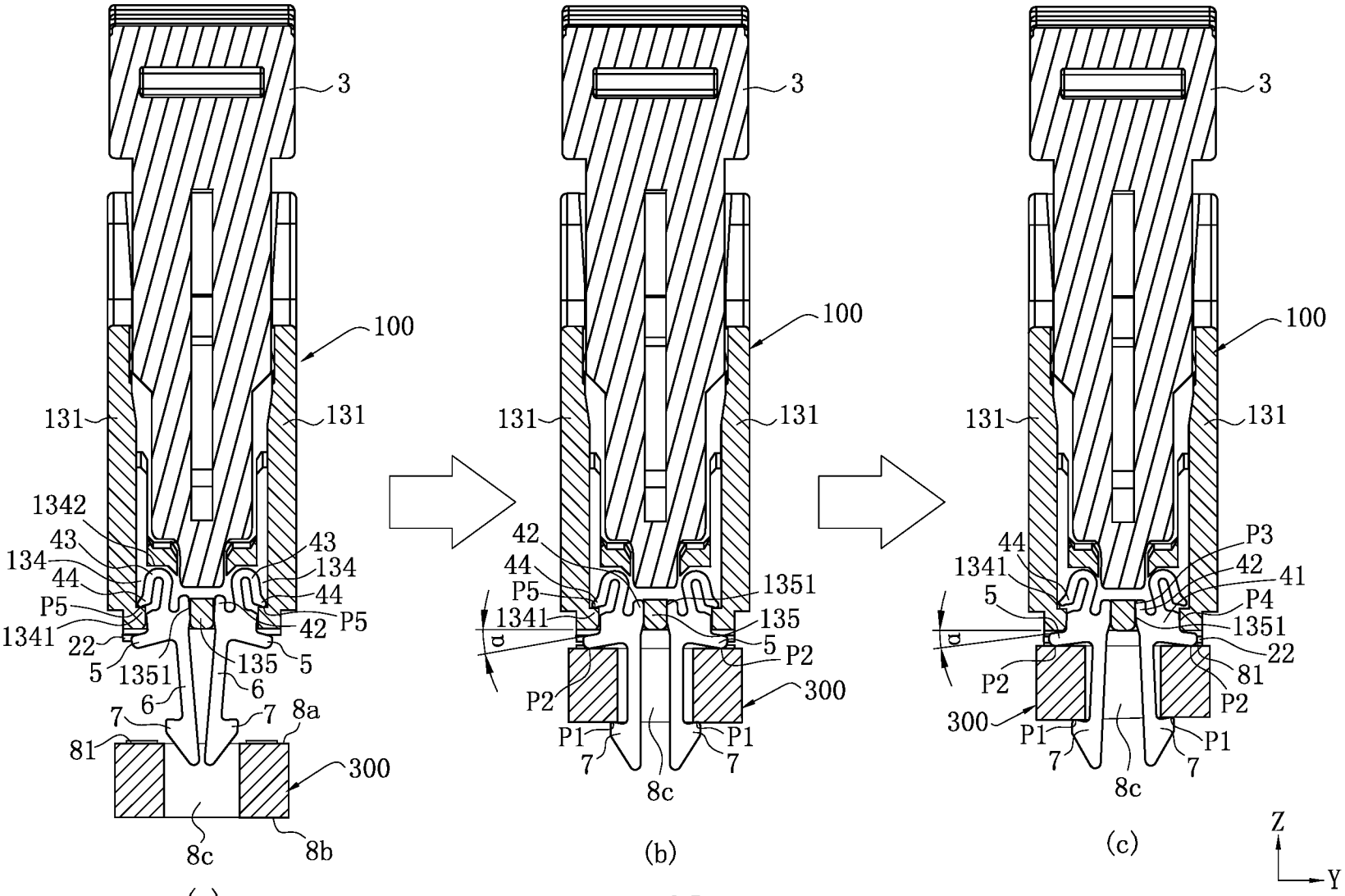
FIG. 7 is a schematic view showing a process of mounting the buckle member in FIG. 1 into a circuit board.

As shown in FIG. 6 and FIG. 7, an assembly process of the assembly device according to the first embodiment of the present invention is as follows. Firstly, the two buckle members 200 connected to the same strip S and distributed mirror-symmetrically are inserted, upward from bottom thereof, into the two mounting slots 134 provided adjacent to each other in the lateral direction Y until the supporting portions 44 of the two buckle members 200 downward abut the position limiting portion 1341.

Secondly, after the buckle members 200 are mounted in the mounting slots 134, the strip S connected to the buckle members 200 is broken from the strip connecting portions 71 thereof.

At this time, with the self-weight of the buckle members 200, the lower ends of the connecting legs 6 of the two adjacent buckle members 200 are close to each other. Of course, an opposing force may be applied to the buckle portions 7 of the two buckle members 200 such that each buckle portion 7 swings around the fifth abutting point P5 toward the adjacent mounting slot 134, the body portion 41 abuts the stopping portion 1351, and an included angle α is formed between the extending portion 5 and the bottom of the electrical connector 100 (i.e., the bottom of the insulating body 1).

Then, each of the through holes 8*c* of the circuit board 300 is aligned with the corresponding two buckle members 200, the electrical connector 100 and the buckle members 200 move downward from top thereof, and the two connecting legs 6 of the two buckle members 200 are inserted downward into the corresponding through hole 8*c*, such that the bottom surface 8*b* of the circuit board 300 is located above the buckle portions 7, and the extending portion 5 abuts the top surface 8*a* of the circuit board 300. At this time, the circuit board 300 continuously applies an upward pushing force to the extending portion 5, such that the included angle α formed between the extending portion 5 and the bottom of the electrical connector 100 decreases. The fifth abutting point P5 of the supporting portion 44 is detached from the position limiting portion 1341 toward the adjacent mounting slot 134. The connecting leg 6 rotationally swings toward one side away from the partition barrier 135, and the buckle portion 7 swings outward from the through hole 8*c*. The body portion 41 is detached from the stopping portion 1351, and the protruding portion 42 abuts the stopping portion 1351 at the third abutting point P3. At this time, the third abutting point P3 is provided at an upper end of the protruding portion 42 in the vertical direction Z, and the buckle portion 7 is provided below the bottom surface 8*b* at the outer side of the through hole 8*c*. If the body portion 41 does not abut the position limiting portion 1341 at this time, the extending portion 5 moves toward one side away from the corresponding through hole 8*c* in the lateral direction Y since the protruding portion 42 is stopped by the stopping portion 1351 until the body portion 41 abuts the position limiting portion 1341. Meanwhile, the protruding portion 42 continuously swings toward the partition barrier 135. That is, the position of the third abutting point P3 on the protruding portion 42 continuously moves upward along the vertical direction Z. The included angle α formed between the extending portion 5 and the bottom of the electrical connector 100 may further decrease. The buckle portion 7 further swings outward from the through hole 8*c*, such that the buckle member 200 may be fastened on the circuit board 300 to prevent the buckle portion 7 from being detached upward from the through hole 8*c*.

In the present embodiment, after the protruding portion 42 abuts the stopping portion 1351 at the third abutting point P3, the fourth abutting point P4 of the body portion 41 abuts the position limiting portion 1341, and the second abutting point P2 of the extending portion 5 still abuts the top surface 8*a* of the circuit board 300. Meanwhile, the buckle portion 7 abuts the bottom surface 8*b* of the circuit board 300 at the first abutting point P1, and the second abutting point P2 is located at the outer side of the corresponding first abutting point P1 in the lateral direction Y, allowing the swinging of the buckle member 200. In other embodiments, the buckle portion 7 may have a smaller distance from the bottom surface 8*b* of the circuit board 300, which still achieves the objective of the present invention.

Finally, the assembly device is heated by a reflow furnace, and a solder on the pad 81 is melted to fixedly solder the conducting portion 22 to the corresponding pad 81.

As shown in FIG. 7, in the assembly process of the assembly device, in the lateral direction Y, the fifth abutting point P5 of the supporting portion 44 is always located between the second abutting point P2 of the extending portion 5 and the first abutting point P1 of the buckle portion 7, such that the fifth abutting point P5 abuts the position limiting portion 1341. Meanwhile, when the second abutting point P2 abuts the top surface 8*a* and the first abutting point P1 abuts the bottom surface 8*b*, the fifth abutting point P5, the second abutting point P2 and the first abutting point P1 may apply a stable supporting force to the buckle member 200 at three points forming a triangle on the buckle member 200, thereby ensuring that the buckle member 200 is provided between the electrical connector 100 and the circuit board 300.

As shown in FIG. 7, after the assembly of the assembly device is completed, in the lateral direction Y, the fourth abutting point P4 of the body portion 41 is located between the second abutting point P2 of the extending portion 5 and the first abutting point P1 of the buckle portion 7, such that the fourth abutting point P4 abuts the position limiting portion 1341. Meanwhile, when the second abutting point P2 abuts the top surface 8*a* and the first abutting point P1 abuts the bottom surface 8*b*, the fourth abutting point P4, the second abutting point P2 and the first abutting point P1 may apply a stable supporting force to the buckle member 200 at three points forming a triangle on the buckle member 200, thereby ensuring that the buckle member 200 is stably provided between the electrical connector 100 and the circuit board 300.

As shown in FIG. 7, in the assembly process of the assembly device, in the lateral direction Y, the first abutting point P1 of the buckle portion 7 is always located between the second abutting point P2 of the extending portion 5 and the third abutting point P3 of the protruding portion 42, such that the third abutting point P3 abuts the stopping portion 1351. Meanwhile, when the second abutting point P2 abuts the top surface 8*a* and the first abutting point P1 abuts the bottom surface 8*b*, the third abutting point P3, the second abutting point P2 and the first abutting point P1 may apply a stable supporting force to the buckle member 200 at three points forming a triangle on the buckle member 200, thereby ensuring that the buckle member 200 is stably provided between the electrical connector 100 and the circuit board 300.

Figure 8:
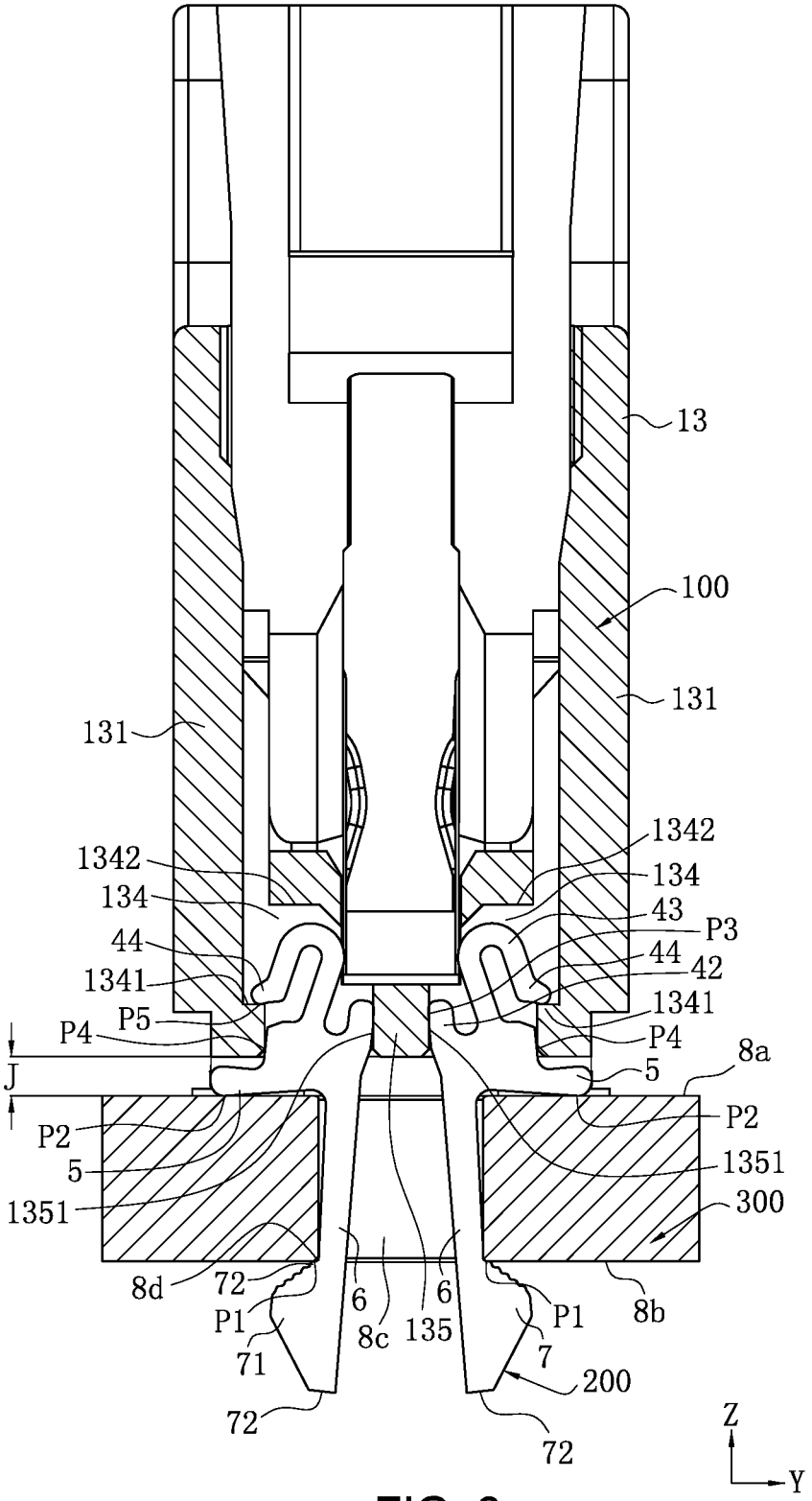
FIG. 8 is a partial sectional view of an assembly device according to a second embodiment of the present invention.

As shown in FIG. 8, the assembly device according to a second embodiment of the present invention is different from the assembly device according to the first embodiment of the present invention in that: the buckle portion 7 extends obliquely downward from the connection leg 6, an included angle between the connecting leg 6 and the buckle portion 7 is an obtuse angle, and the buckle portion 7 is provided with multiple protrusions 72 along the extending direction thereof. A joint 8*d* of the bottom surface 8*b* of the circuit board 300 and the through hole 8*c* is engaged with one of the protrusions 72 such that when the circuit board 300 is subject to a downward acting force, one of the protrusions 72 inevitably applies an upward stopping force to the circuit board 300 to prevent the circuit board 300 from moving downward, i.e., to stop the buckle portion 7 from moving upward. In the present embodiment, the protrusion 72 is a circular arc protrusion. In other embodiments, the protrusion 72 is a sharp corner protrusion.

As shown in FIG. 9 to FIG. 15, the assembly device according to a third embodiment of the present invention is different from the assembly device according to the first embodiment of the present invention in: the structure of each mounting slot 134, the structure of each buckle member 200, the mating relationship between each mounting slot 134 and the corresponding buckle member 200, the position of each buckle member 200 on the insulating body 1, and the step of mounting the buckle members 200 to the mounting slots 134. Other structures thereof are the same as those of the assembly device according to the first embodiment of the present invention, and descriptions thereof are not elaborated herein.

Figure 11:
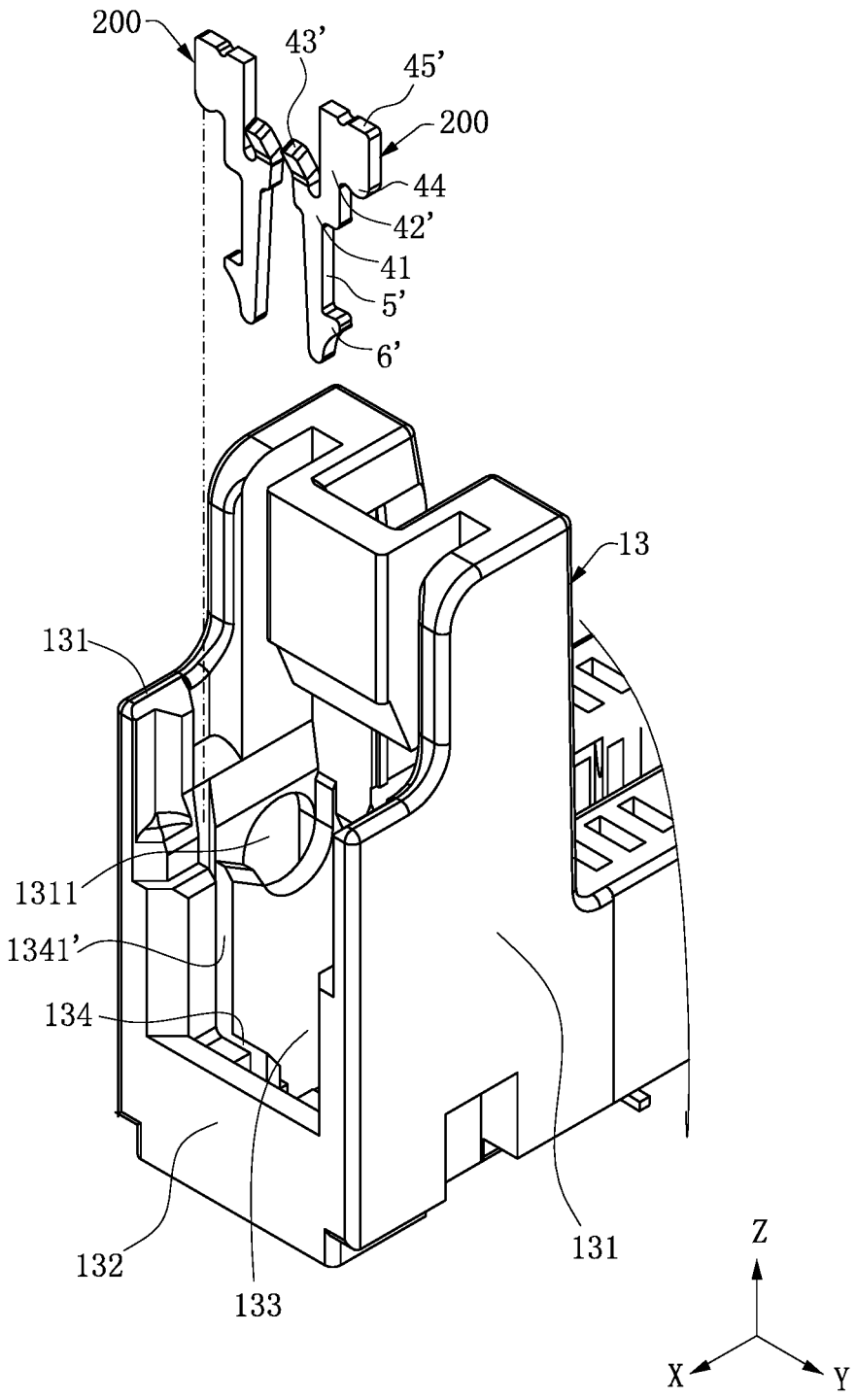
FIG. 11 is a partially enlarged view in FIG. 9.
Figure 12:
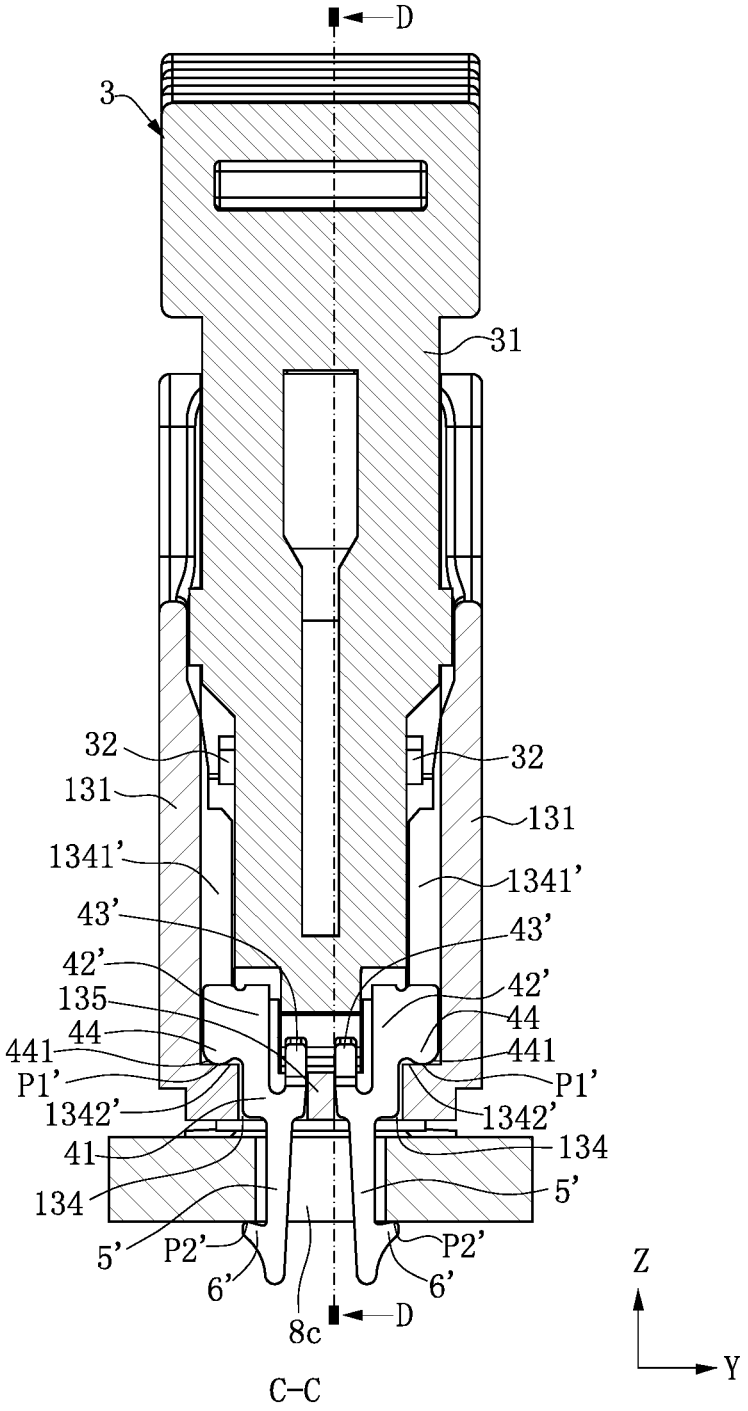
FIG. 12 is a sectional view in FIG. 10 along a C-C direction.

As shown in FIG. 11 and FIG. 12, each of the mounting portions 13 is provided with two mounting slots 134. A portion of each of the mounting slots 134 penetrates the corresponding end wall 132 vertically, and another portion is provided on the side wall 131 adjacent thereto. Specifically, each of the mounting slots 134 has a groove 1341', which is concavely formed on the corresponding side wall 131 downward from top thereof. The groove 1341' does not penetrate the corresponding mounting portion 13 downward, and the groove 1341' penetrates an inner wall surface of the side wall 131. A bearing portion 1342' is formed at the bottom of the groove 1341'. In the present embodiment, the bearing portion 1342' is a horizontal surface facing upward. In other embodiments, the mounting slots 134 may all be provided in the corresponding end wall 132. In still another embodiment, the bearing portion 1342' may be an arc-shaped concave surface.

Figure 14:
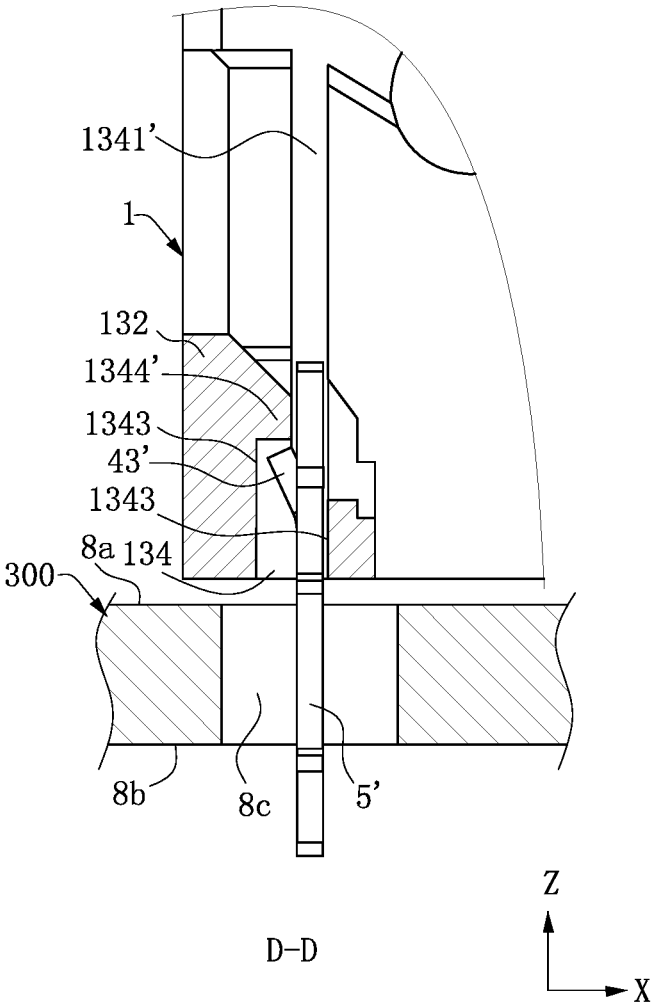
FIG. 14 is a partially sectional view of only an insulating body in FIG. 12 along a D-D direction with an ear clip being removed.

As shown in FIG. 12 and FIG. 14, each of the mounting slots 134 has two slot walls 1343 provided opposite to each other. The two slot walls 1343 are provided at an interval in the lengthwise direction X. One of the slot walls 1343 at the outer side protrudes to the other slot wall 1343 to form a stopper 1344'. The two stoppers 1344' provided at the same end of the insertion slot 12 are symmetrically distributed at both sides of the corresponding partition barrier 135.

Figure 13:
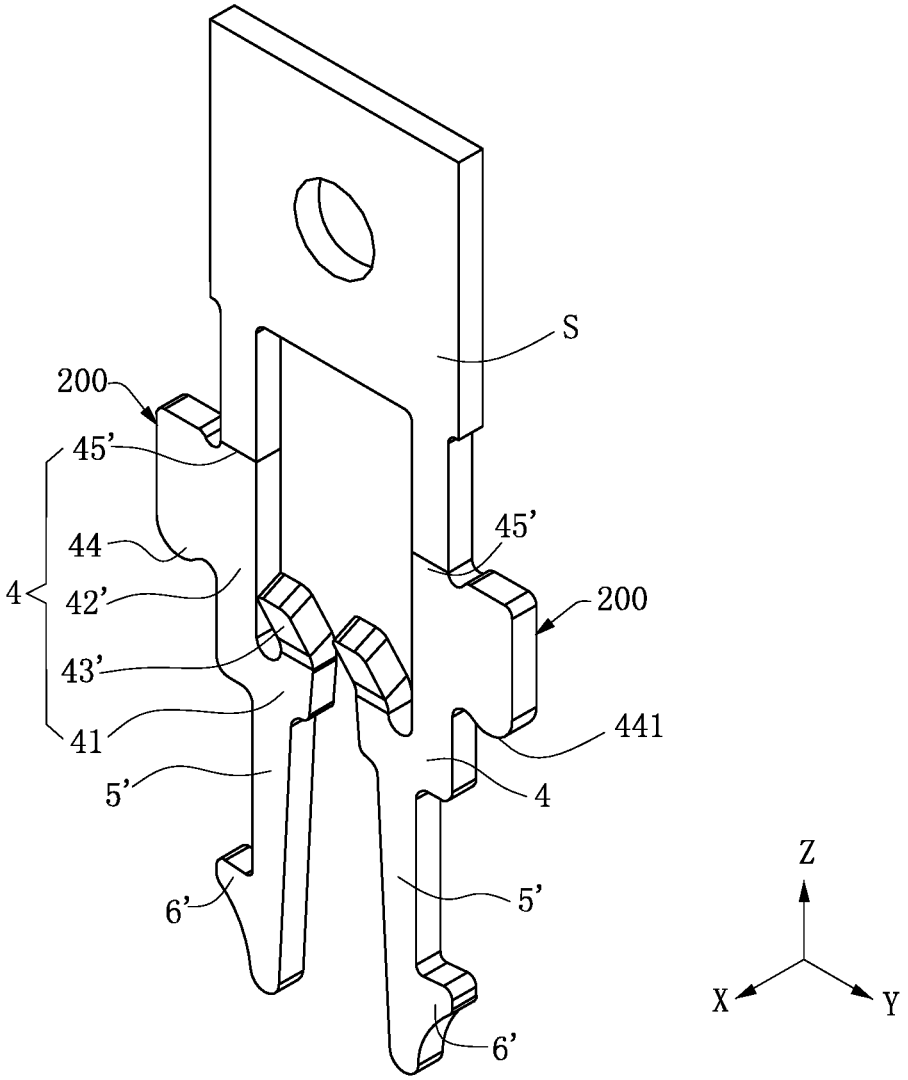
FIG. 13 is a perspective view of a buckle member in FIG. 9 before strip folding.

As shown in FIG. 11 and FIG. 13, each buckle member 200 is made of a metal plate, and includes a base 4, a connecting leg 5' connected to a lower end of the base 4, and a buckle portion 6' connected to the other end of the connecting leg 5'. Each of the mounting slots 134 is correspondingly provided with one buckle member 200, and the buckle member 200 is assembled on the corresponding mounting slot 134 downward from top thereof. The two adjacent buckle members 200 mounted on each of the mounting portions 13 are provided mirror-symmetrically.

As shown in FIG. 12, FIG. 13 and FIG. 14, the base 4 is provided in the mounting slot 134, and is in loose fit with the corresponding mounting slot 134. The base 4 includes a body portion 41 extending upward from the connecting leg 5'. A connecting portion 42' and an elastic sheet 43' extend upward from different positions of an upper end of the body portion 41. The connecting portion 42' is offset from the connecting leg 5' in the lateral direction Y. A gap is formed between the connecting portion 42' and the elastic sheet 43'. The elastic sheet 43' is deviated from a vertical plane where the body portion 41 is located, and extends toward the corresponding stopper 1344', and the stopper 1344' is located above the elastic sheet 43'. Thus, the buckle member 200 may be limited from moving upward excessively, and is prevented from being detached upward from the insulating body 1. A supporting portion 44 protrudes from one side of an upper end of the connecting portion 42'. The supporting portion 44 and the elastic sheet 43' are located at opposite sides of the connecting portion 42'. The supporting portion 44 is received in the groove 1341'. The supporting portion 44 has an arc-shaped surface 441 located at a lower end thereof, and the arc-shaped surface 441 abuts the bearing portion 1342', such that the supporting portion 44 and the bearing portion 1342' form a pivot point P1', and the supporting portion 44 and the bearing portion 1342' are in a moving fit. The connecting portion 42' is provided with a strip connecting portion 45' for connecting a strip S. The buckle portion 6' extends obliquely upward from the connecting leg 5', thereby increasing the buckle strength of the buckle portion 6' for the circuit board 300. In addition, an inclined angle of the buckle portion 6' may be selected according to different customer demands.

Figure 9:
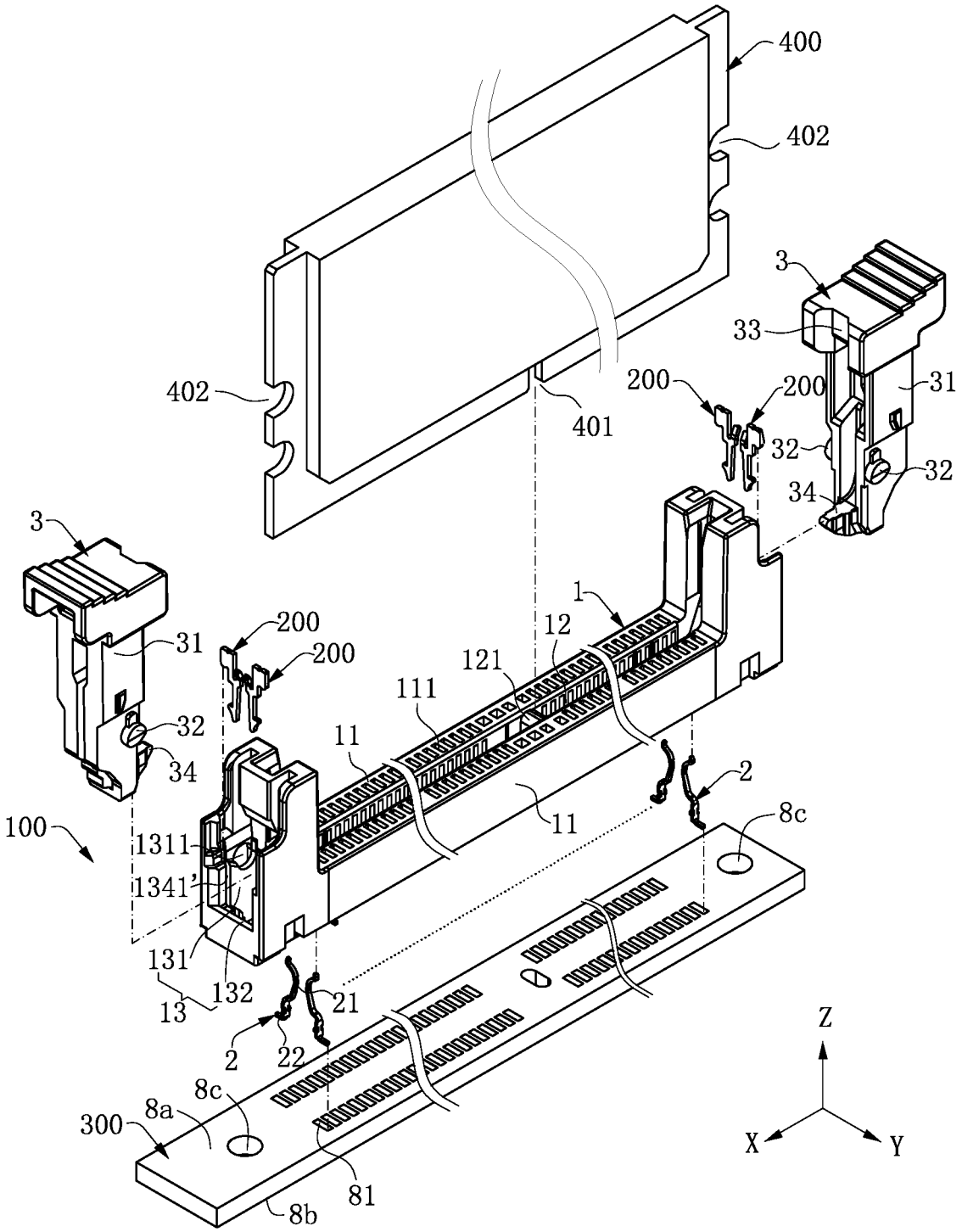
FIG. 9 is an exploded view of an assembly device according to a third embodiment of the present invention.
Figure 10:
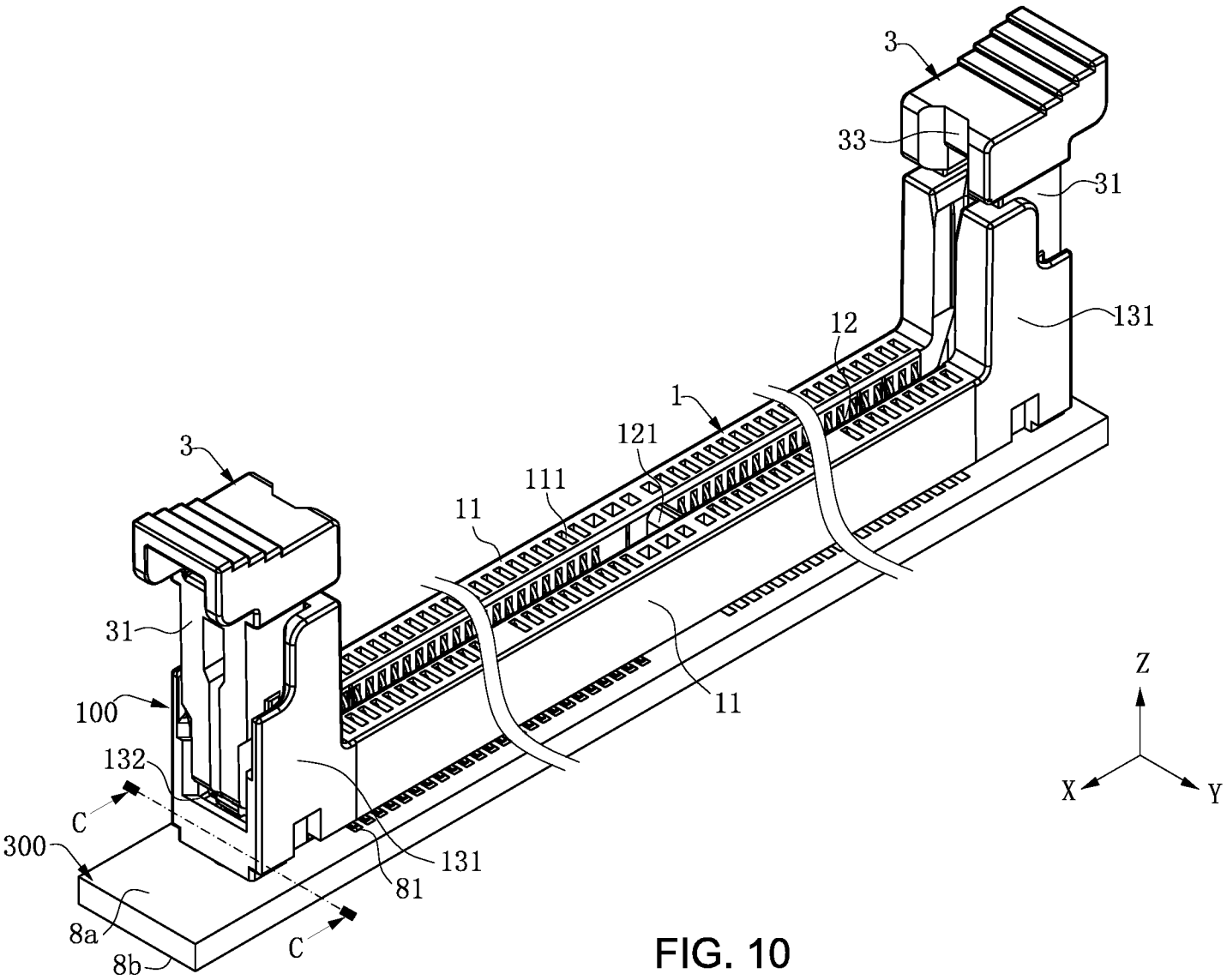
FIG. 10 is an assembled view of FIG. 9.
Figure 15:
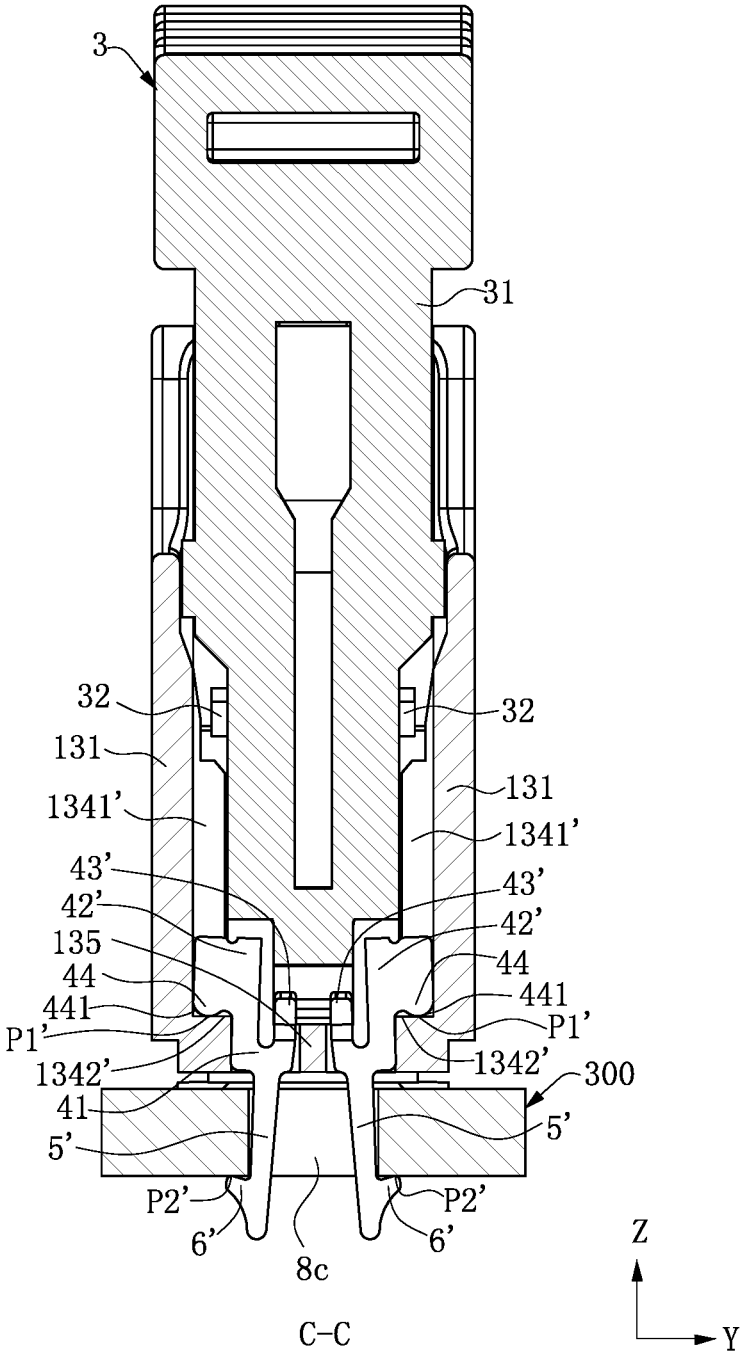
FIG. 15 is a schematic view of a buckle member in FIG. 12 in a force applying state.

As shown in FIG. 9 and FIG. 12, two through holes 8*c* are provided. The two through holes 8*c* are in one-to-one correspondence with the two mounting portions 13 vertically. The buckle portion 6' is located below the bottom surface 8*b* and fastens the bottom surface 8*b* upward, and a buckle point P2' is formed therebetween. The pivot point P1' is provided farther away from the corresponding through hole 8*c* than the buckle point P2' in the lateral direction Y, and the two buckle portions 6' corresponding to the same through hole 8*c* protrude away from each other in the lateral direction Y. As shown in FIG. 12 and FIG. 15, when the buckle portion 6' is subject to a downward force of the circuit board 300, the buckle member 200 rotates in the mounting slot 134 around the pivot point P1', so as to adjust the buckle portion 6', such that the buckle portion 6' is fastened on the circuit board 300. At this time, the position of the pivot point P1' in the mounting slot 134 is changed.

As shown in FIG. 9, FIG. 12 and FIG. 15, the assembly device according to the third embodiment of the present invention basically operates as follows:

Firstly, before the buckle member 200 is mounted in the mounting slot 134, the two buckle members 200 corresponding to each of the mounting portions 13 are connected to the same strip S, and the two buckle members 200 are correspondingly mounted in the two adjacent mounting slots 134 downward from top thereof at the same time by the strip S. At this time, the elastic sheet 43' is located below the stopper 1344', and the supporting portion 44 is supported on the bearing portion 1342'.

Then, the strip S is removed.

Next, the circuit board 300 is provided below the electrical connector 100, and the connecting leg 5' is aligned with and received in the corresponding through hole 8*c*, such that the buckle portion 6' buckles the bottom surface 8*b*, and then the conducting portion 22 is correspondingly placed on the pad 81 with a solder. When the buckle portion 6' is subject to a downward force of the circuit board 300, the buckle member 200 rotates in the corresponding mounting slot 134. Meanwhile, the buckle portion 6' swings outward from the corresponding through hole 8*c* in the lateral direction Y around the pivot point P1'. That is, the buckle point P2' moves toward the pivot point P1' in the lateral direction Y, such that the buckle portion 6' is fastened to the bottom surface 8*b*, thereby firmly fastening the circuit board 300, and ensuring the buckle effect.

Finally, the assembly device is heated by a reflow furnace, and a solder on the pad 81 is melted to fixedly solder the conducting portion 22 to the corresponding pad 81.

Figure 16:
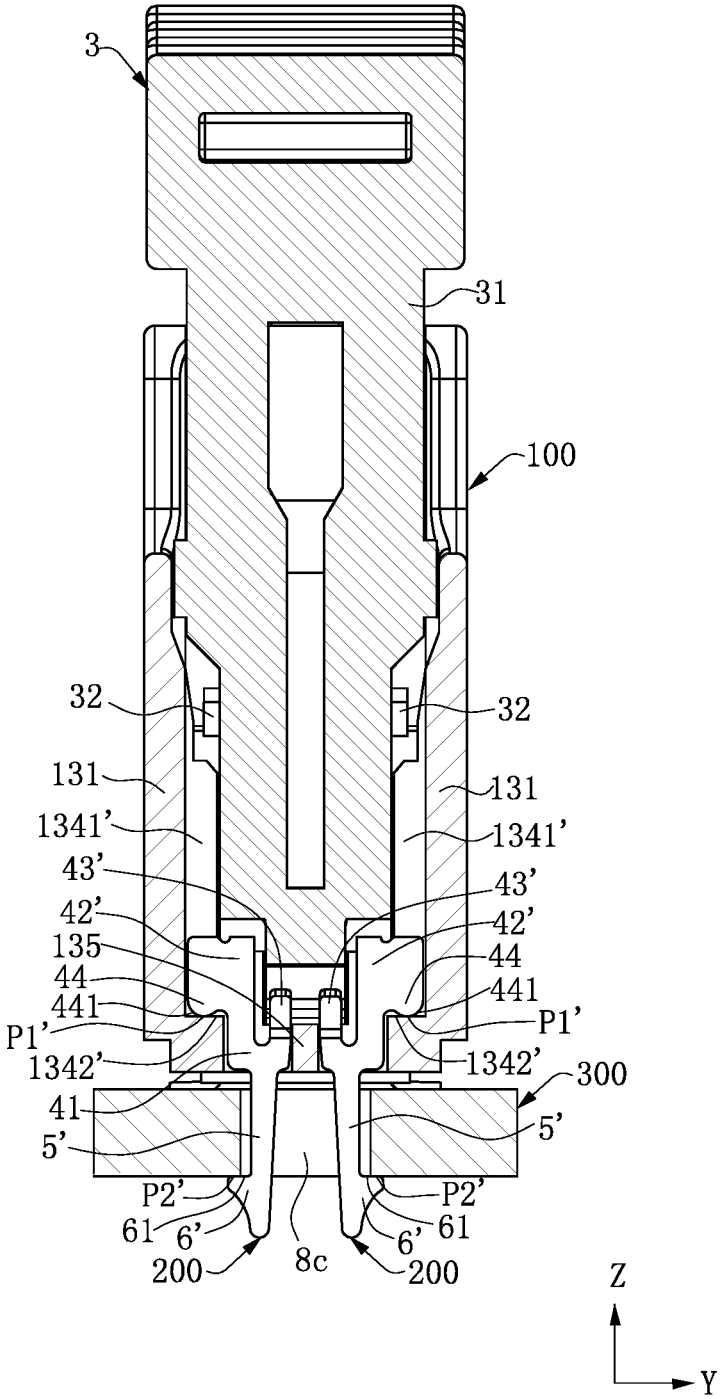
FIG. 16 is a schematic view of an assembly device according to a fourth embodiment of the present invention.
Figure 17:
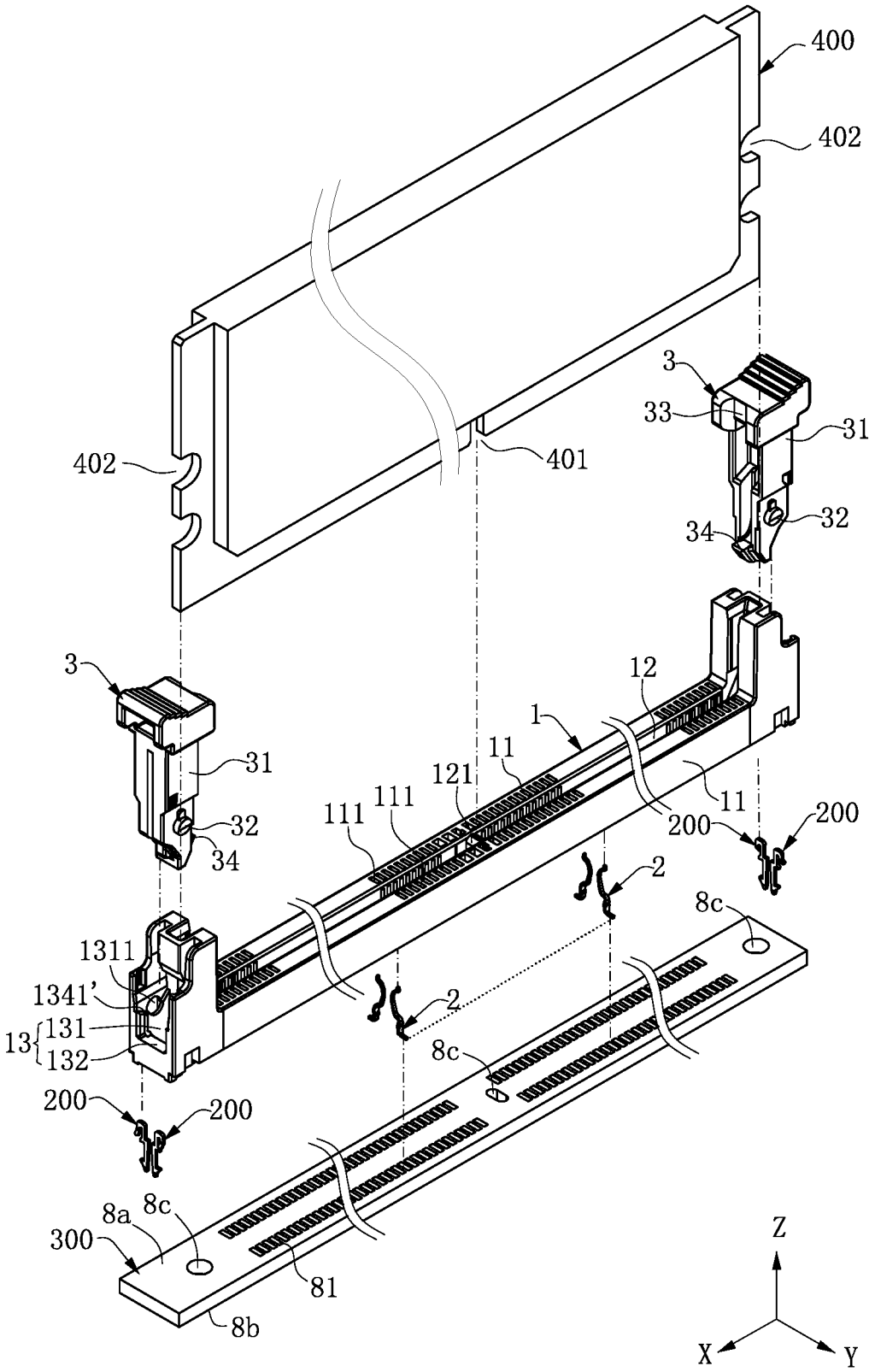
FIG. 17 is an exploded view of an assembly device according to a fifth embodiment of the present invention.
Figure 18:
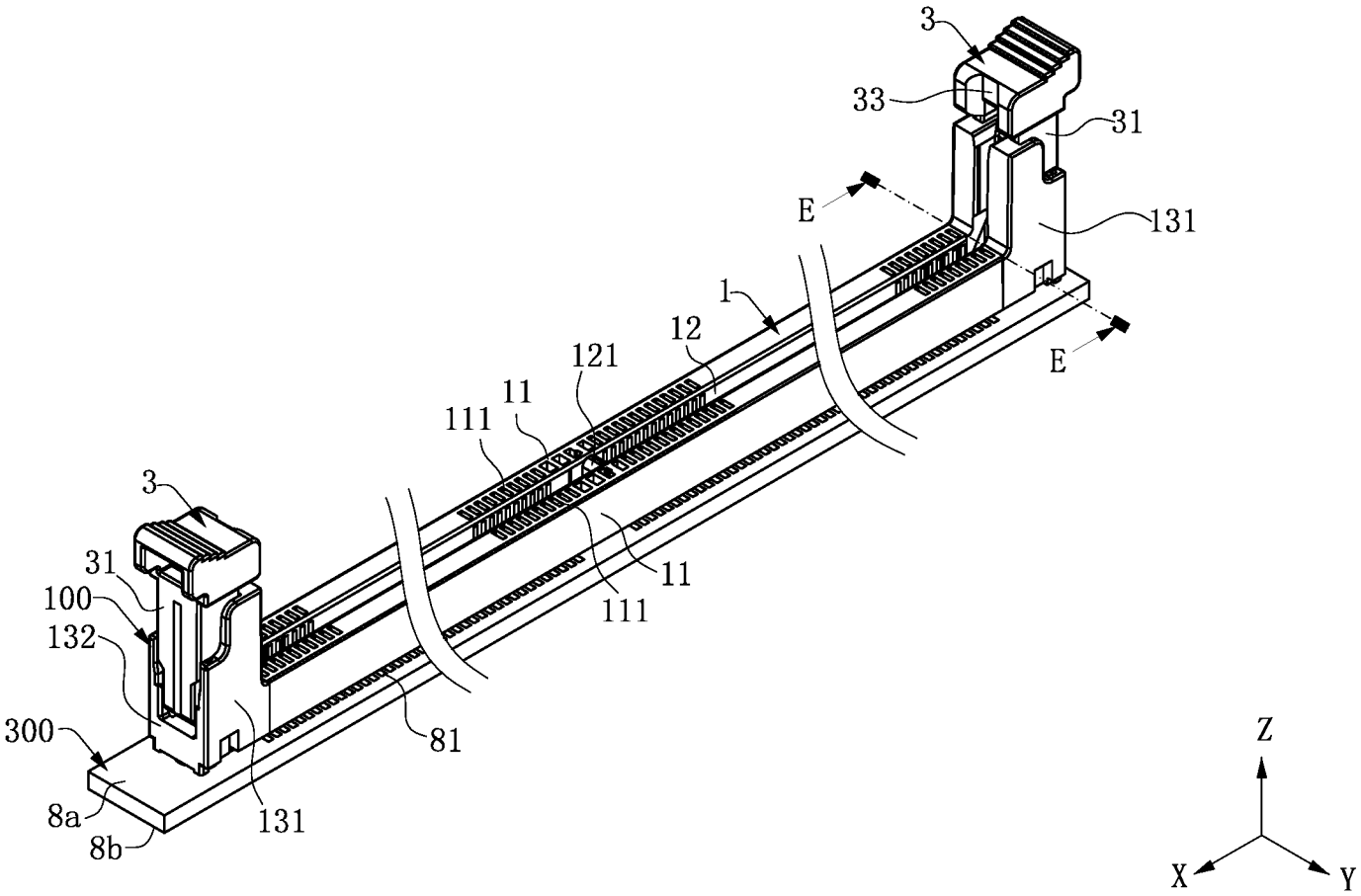
FIG. 18 is an assembled view of FIG. 17.

As shown in FIG. 16, the assembly device according to the fourth embodiment of the present invention is different from the assembly device according to the third embodiment of the present invention in that: the buckle portion 6' has an upper surface 6'1 provided horizontally, the upper surface 6'1 fastens the bottom surface 8*b* of the circuit board 300 upward, and the fastening effect may also be achieved.

As shown in FIG. 17 to FIG. 23, the assembly device according to the fifth embodiment of the present invention is different from the assembly device according to the third embodiment of the present invention in that: in the present embodiment, the insulating body 1 is respectively provided with two mounting portions 13 at both ends of the insertion slot 12. Each of the mounting slots 134 has a groove 1341', which is concavely formed at a position of the corresponding end wall 132 close to the side wall 131 downward from top thereof. The groove 1341' does not penetrate the mounting portion 13 downward, and the groove 1341' penetrates an inner wall surface of the end wall 132. A bearing portion 1342' is formed at the bottom of the groove 1341'. Each of the mounting portions 13 is provided with two mounting slots 134. The two mounting slots 134 are provided at an interval in the lateral direction Y, and a partition barrier 135 is provided therebetween. Each of the mounting slots 134 has two slot walls 1343 provided opposite to each other. The two slot walls 1343 are provided at an interval in the lengthwise direction X. One of the slot walls 1343 on the outer side protrudes toward the other slot wall 1343 to form a stopper 1344'. The two stoppers 1344' provided at the same end of the insertion slot 12 are connected to the partition barrier 135 respectively. Each stopper 1344' is provided with a flange 1345 having an arc-shaped surface.

Figure 20:
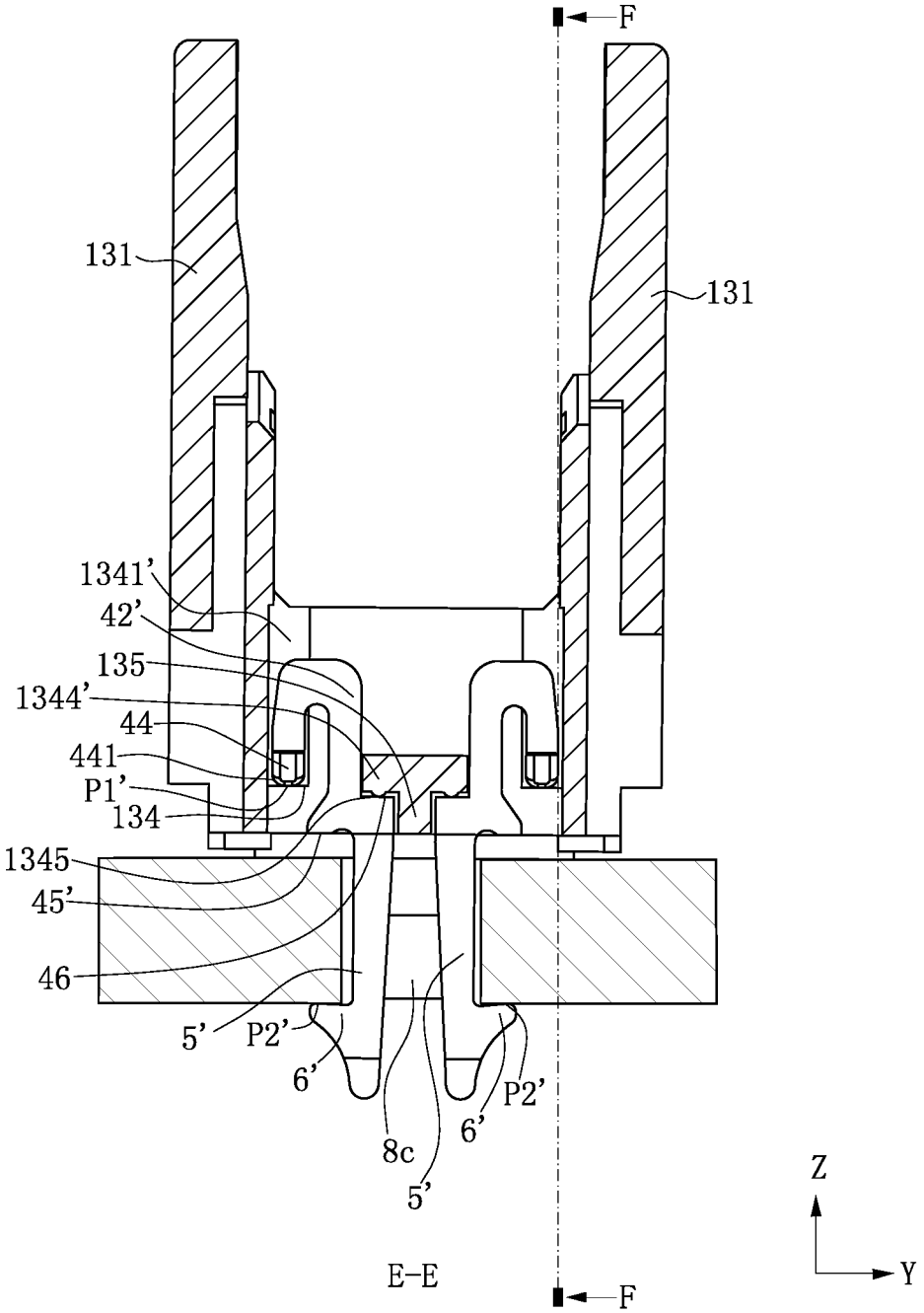
FIG. 20 is a sectional view of FIG. 18 along an E-E direction with an ear clip being removed.
Figure 21:
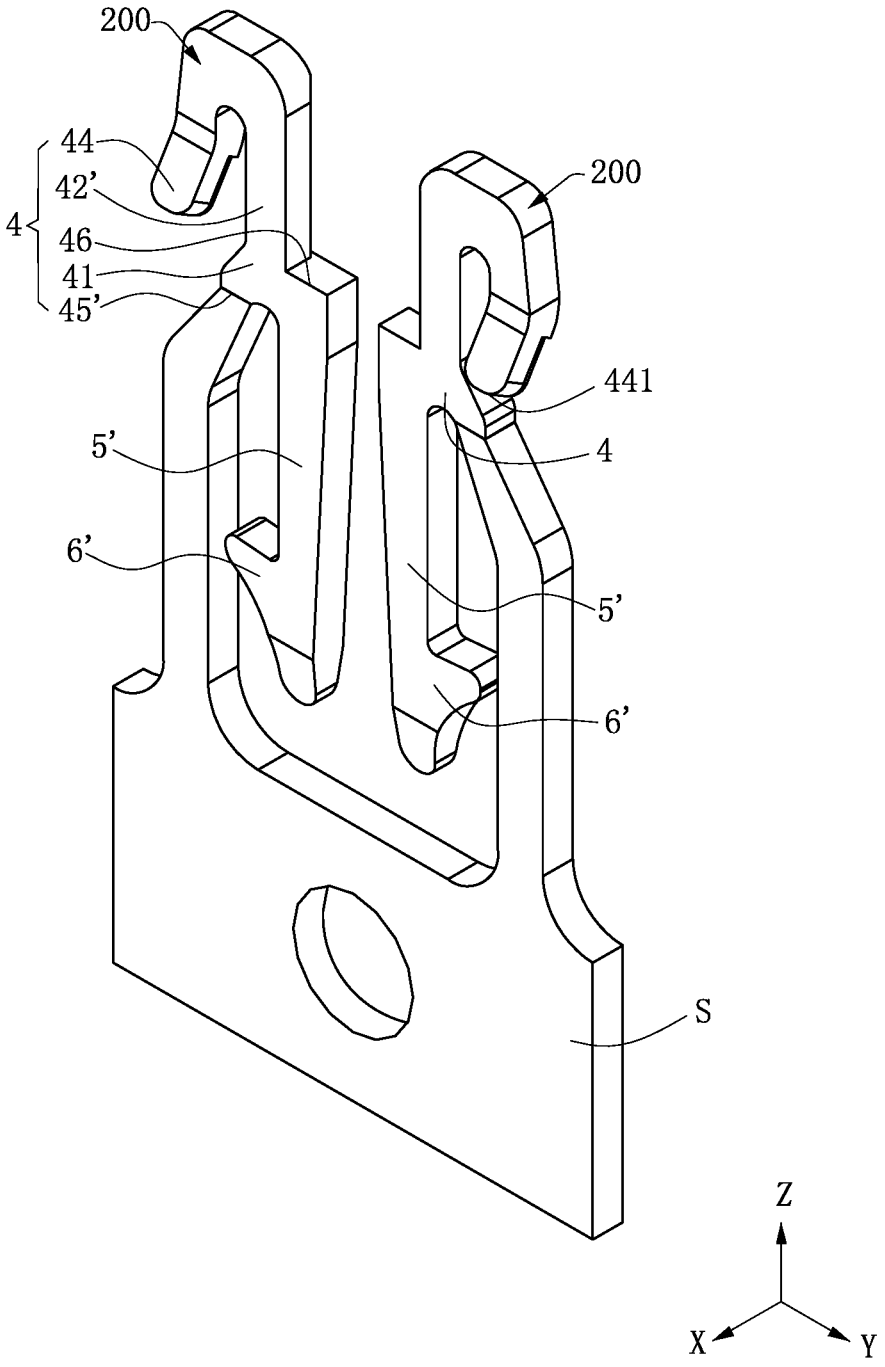
FIG. 21 is a perspective view of a buckle member in FIG. 17 before strip folding.
Figure 22:
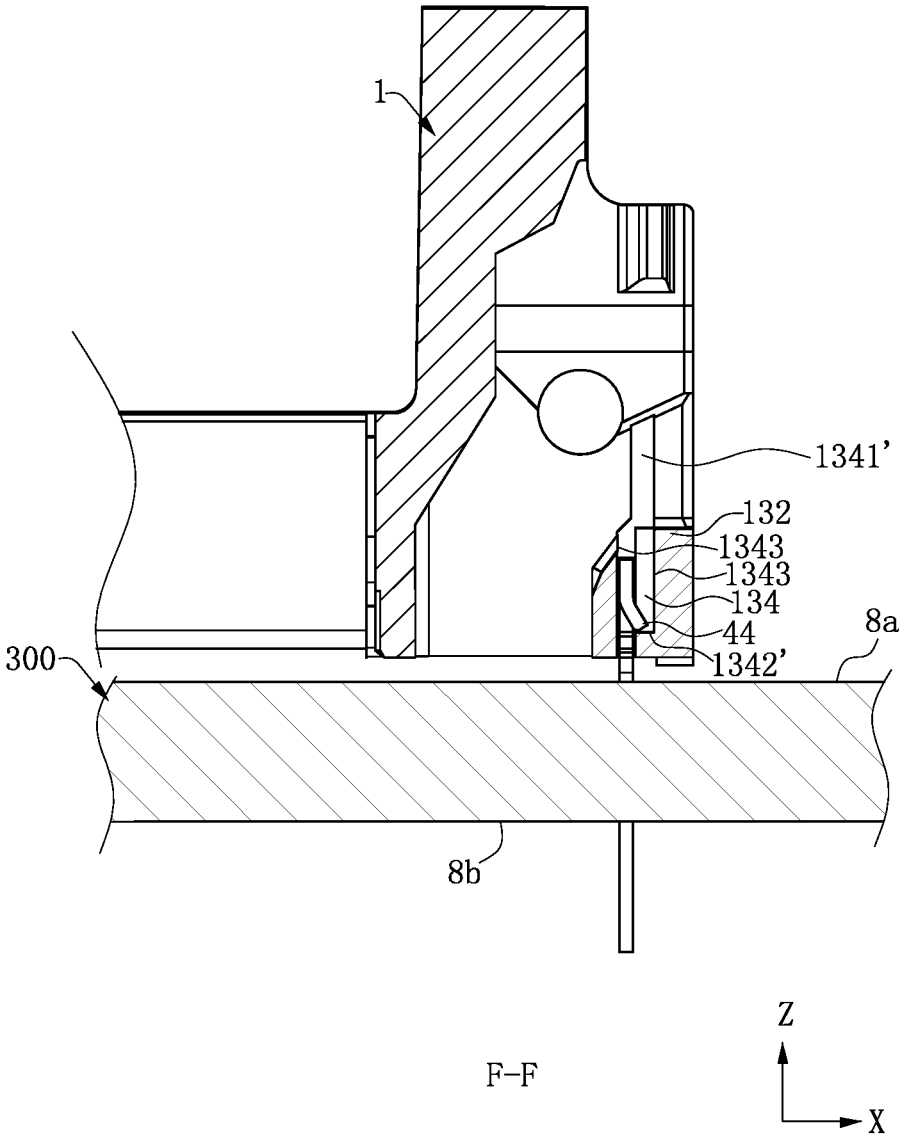
FIG. 22 is a partially sectional view of only an insulating body in FIG. 20 along an F-F direction with an ear clip being removed.

As shown in FIG. 20, FIG. 21 and FIG. 22, in the present embodiment, the base 4 is provided in the corresponding mounting slot 134 and is in loose fit with the mounting slot 134. The base 4 includes a body portion 41 extending upward from the connecting leg 5'. A connecting portion 42' extends upward from an upper end of the body portion 41. A supporting portion 44 is formed downward from one side of an upper end of the connecting portion 42' and toward the groove 1341'. The supporting portion 44 is provided obliquely relative to a plane where the base 4 is located. A gap exists between the supporting portion 44 and the connecting portion 42', and the supporting portion 44 is partially received in the groove 1341'. The supporting portion 44 has an arc-shaped surface 441 located at a lower end thereof. The arc-shaped surface 441 abuts the bearing portion 1342', such that the supporting portion 44 and the bearing portion 1342' form a pivot point P1', and the supporting portion 44 and the bearing portion 1342' is in a moving fit.

Figure 19:
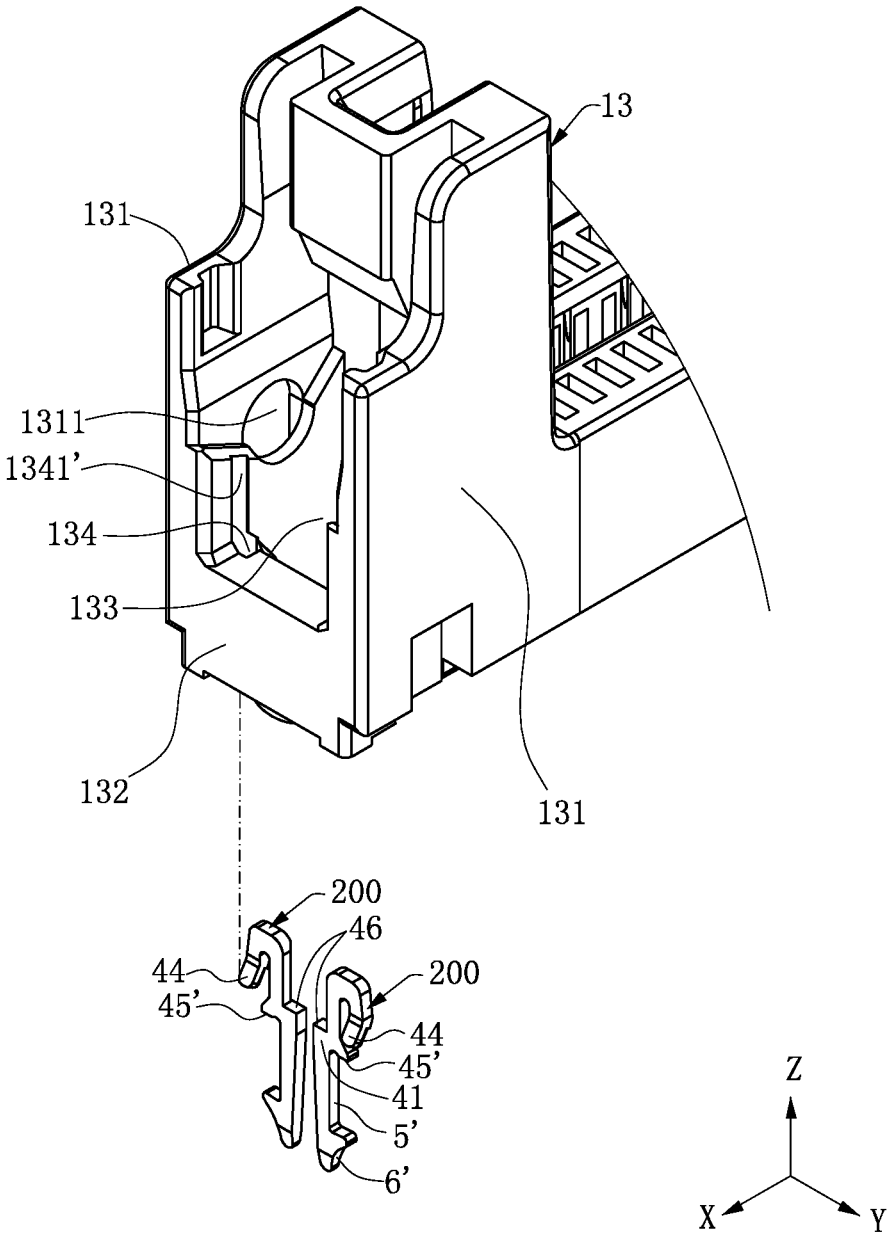
FIG. 19 is a partially enlarged view in FIG. 17.
Figure 23:
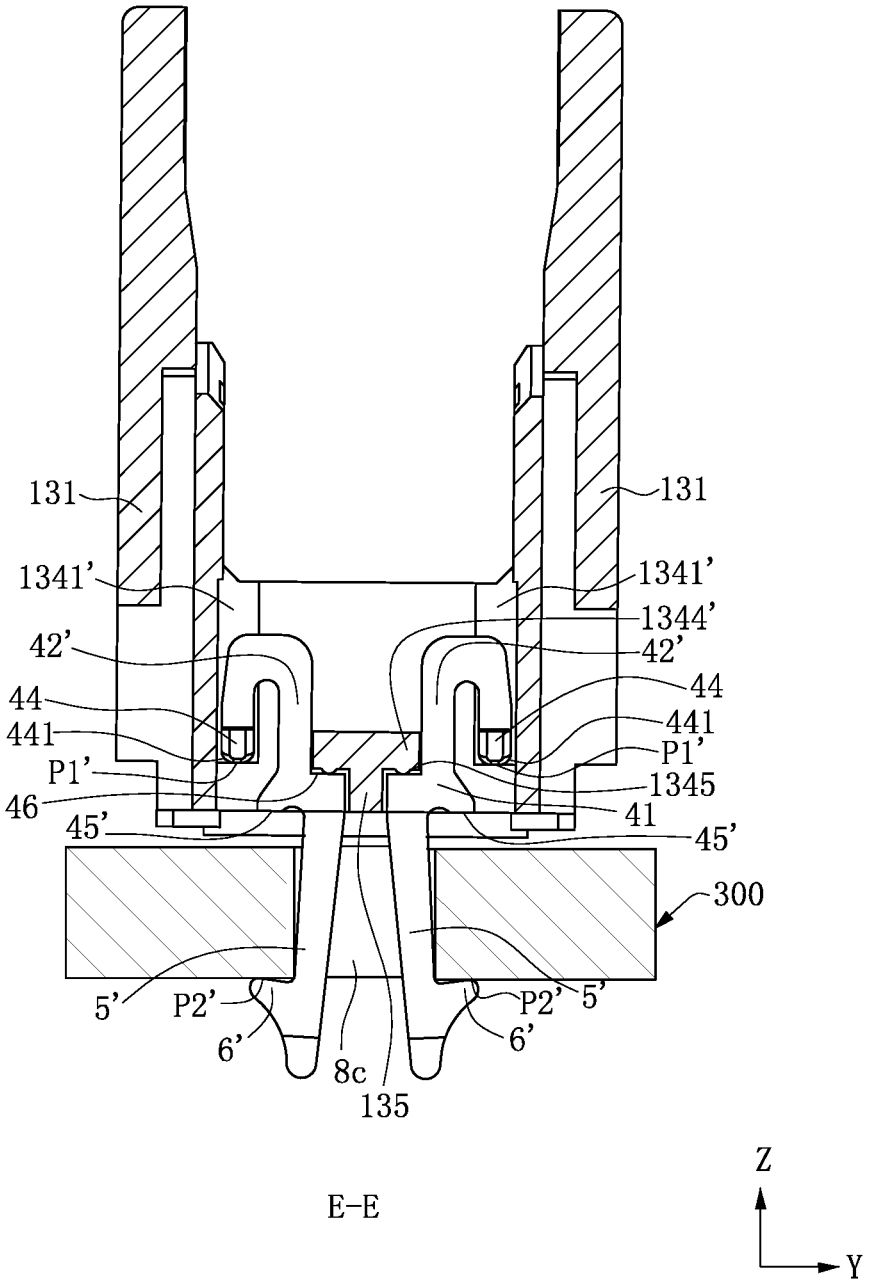
FIG. 23 is a schematic view of a buckle member in FIG. 20 in a force applying state.
Figure 24:
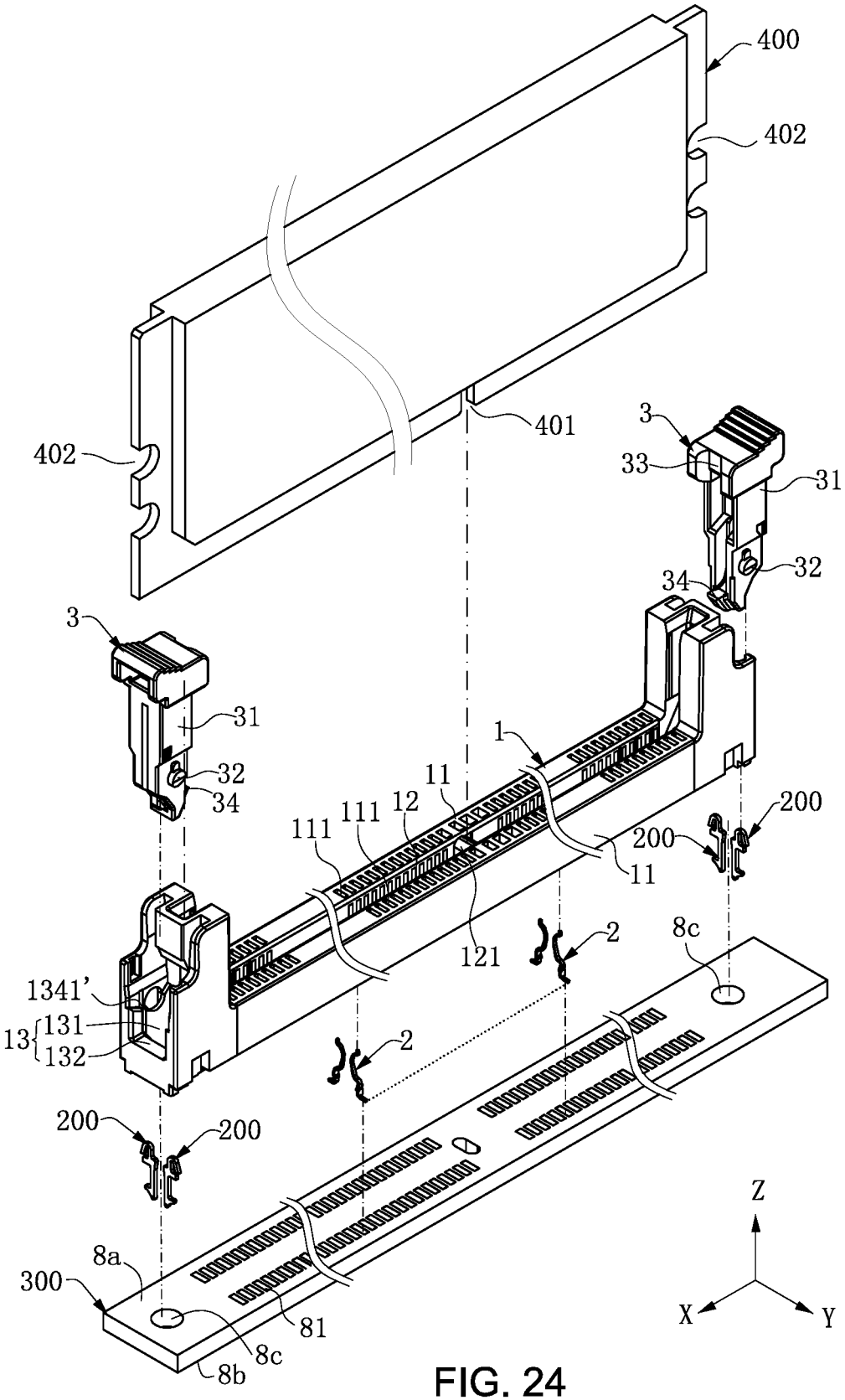
FIG. 24 is an exploded view of an assembly device according to a sixth embodiment of the present invention.
Figure 25:
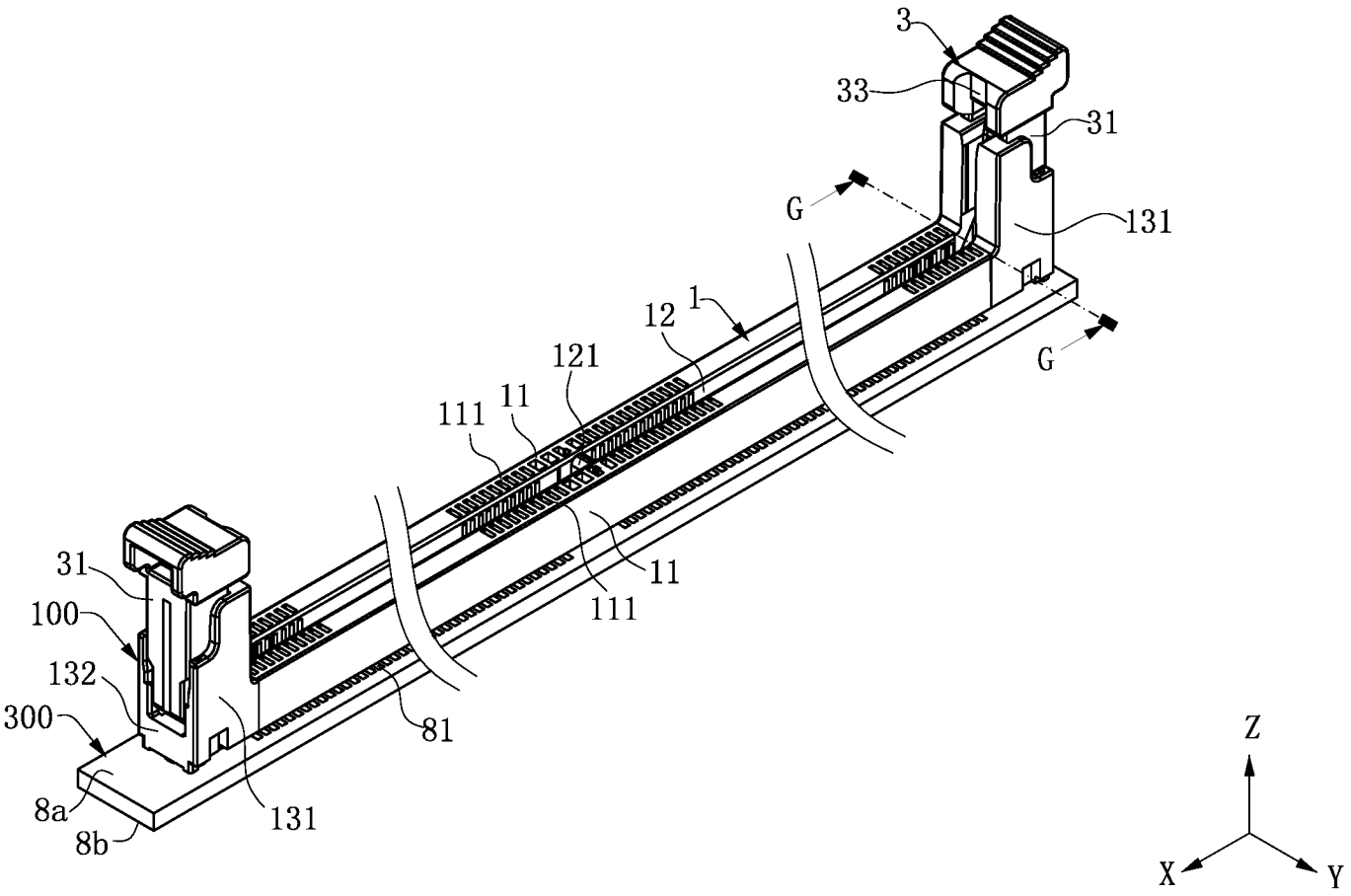
FIG. 25 is an assembled view of FIG. 24.
Figure 26:
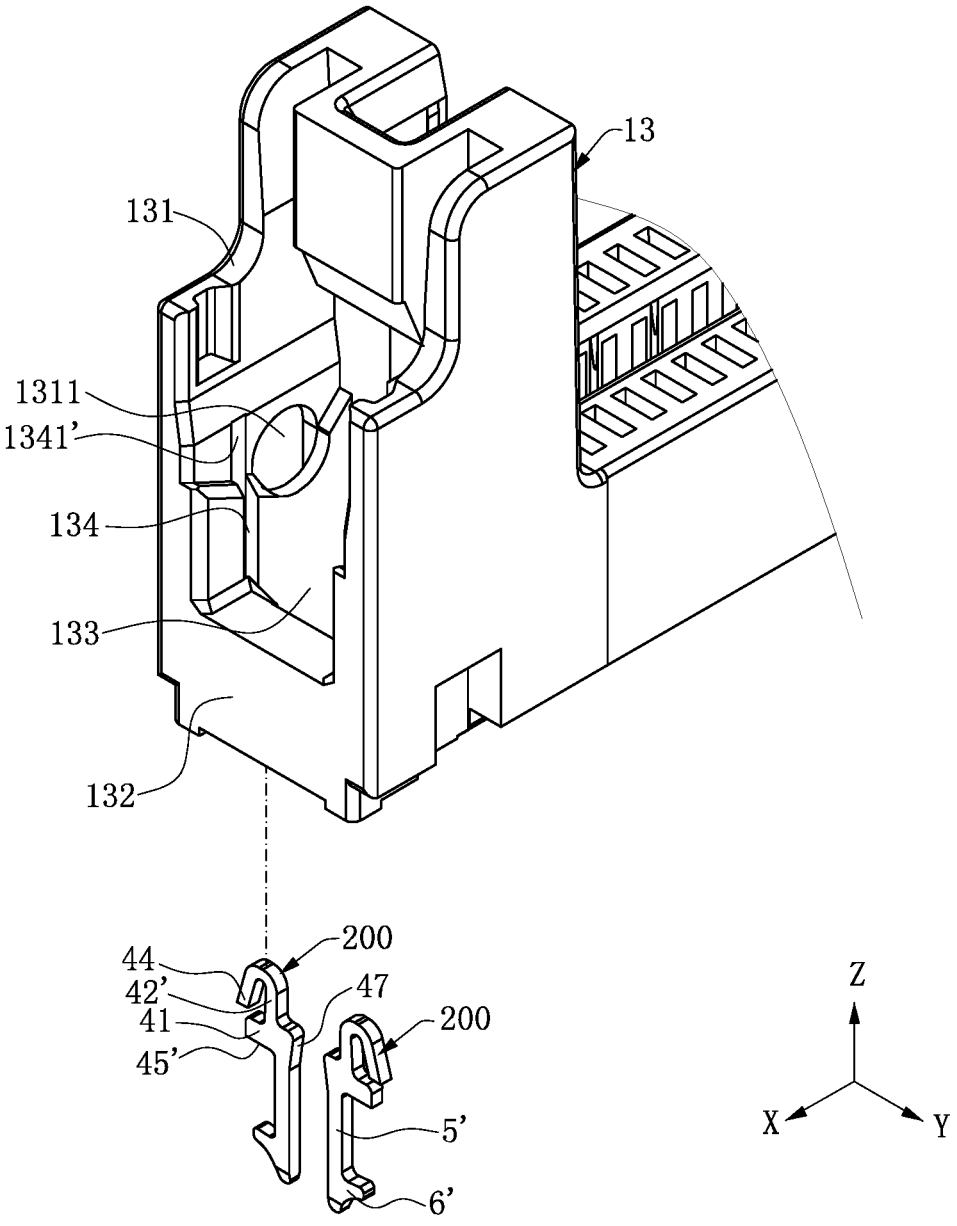
FIG. 26 is a partially enlarged view in FIG. 24.

As shown in FIG. 19, FIG. 20 and FIG. 21, in the present embodiment, the body portion 41 extends downward to form the strip connecting portion 45'. Before each buckle member 200 is mounted in the corresponding mounting slot 134, the two buckle members 200 corresponding to each of the mounting portions 13 are connected to the same strip S, and the two buckle members 200 are correspondingly assembled in the two adjacent mounting slots 134 upward from bottom thereof at the same time by the strip S. As shown in FIG. 21 and FIG. 23, a stop portion 46 is formed at another position of the upper end of the body portion 41. The stop portion 46 and the supporting portion 44 are located at opposite sides of the connecting portion 42'. The arc-shaped surface of the flange 1345 abuts the stop portion 46, and the stopper 1344' is located above the stop portion 46 to limit the buckle member 200 from moving upward excessively, thereby preventing the buckle member 200 from being detached upward from the electrical connector 100.

As shown in FIG. 20, FIG. 21 and FIG. 23, when the buckle portion 6' is subject to a downward force of the circuit board 300, the buckle member 200 rotates in the corresponding mounting slot 134. Meanwhile, the buckle portion 6' is stressed to swing outward from the corresponding through hole 8*c* in the lateral direction Y. That is, the buckle point P2' moves toward the pivot point P1' in the lateral direction Y, such that the buckle portion 6' is fastened to the circuit board 300.

As shown in FIG. 24 to FIG. 30, the assembly device according to the sixth embodiment of the present invention is different from the assembly device according to the fifth embodiment of the present invention in that: in the present embodiment, the stopper 1344' is connected to the two slot walls 1343 of the mounting slot 134, and the stopper 1344' is located above the buckle member 200 to prevent the buckle member 200 from moving upward excessively.

Figure 27:
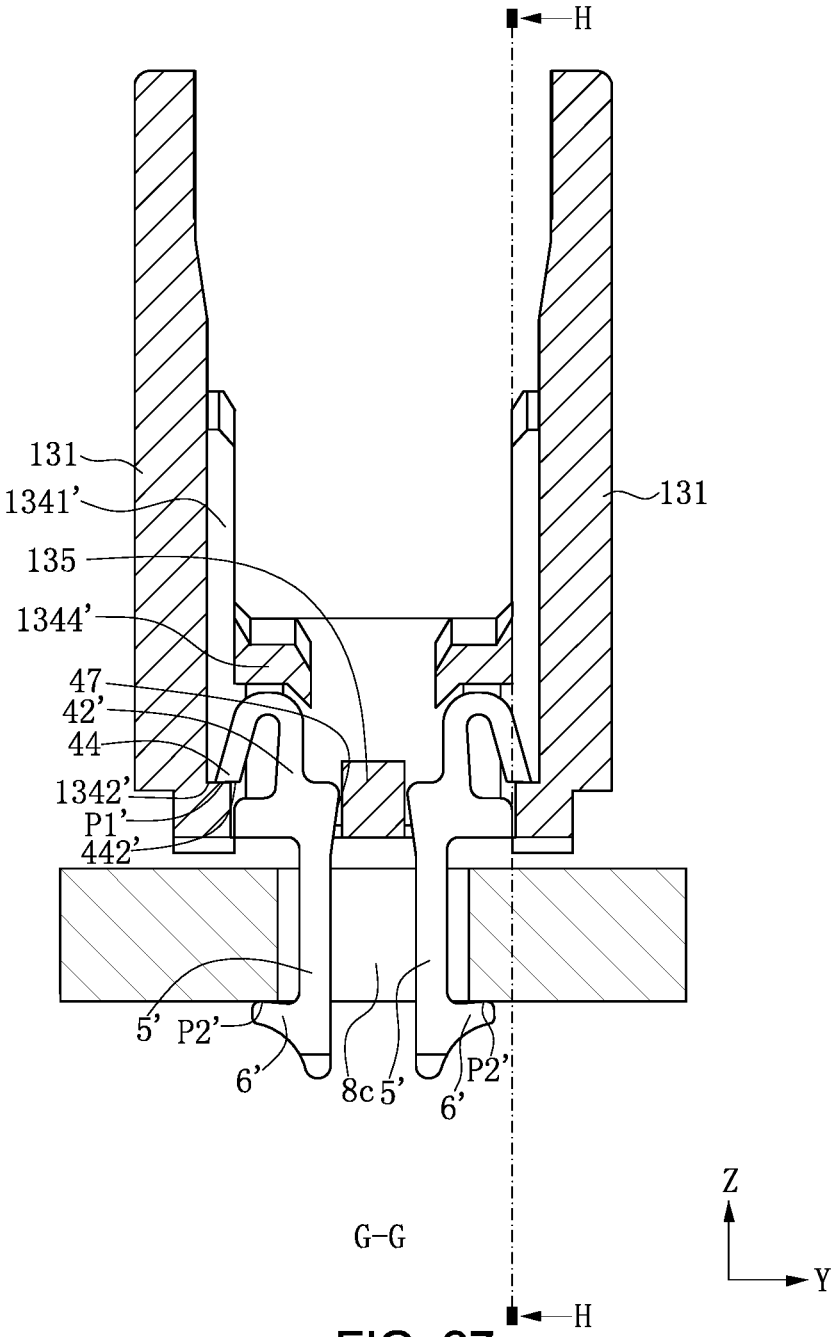
FIG. 27 is a sectional view of FIG. 25 along a G-G direction with an ear clip being removed.
Figure 30:
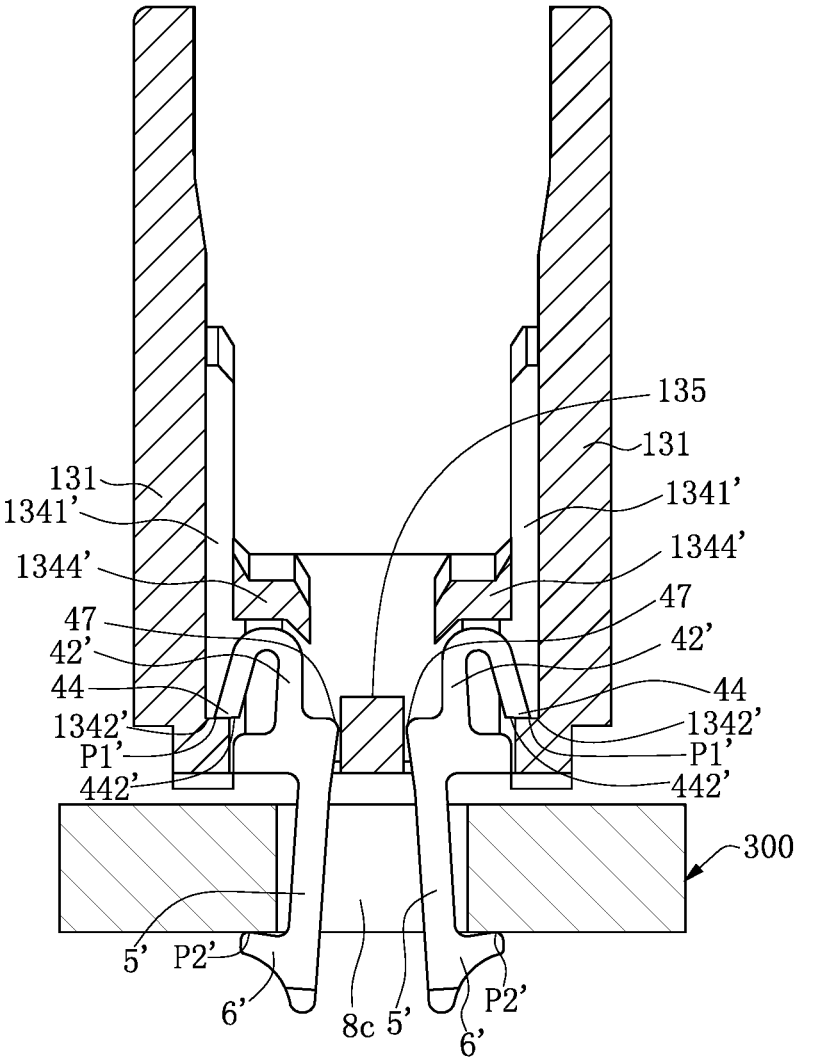
FIG. 30 is a schematic view of a buckle member in FIG. 27 in a force applying state.
Figure 30:
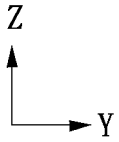

As shown in FIG. 27 and FIG. 30, in the present embodiment, the base 4 is provided in the corresponding mounting slot 134 and is in loose fit with the mounting slot 134. The base 4 includes a body portion 41 extending upward from the connecting leg 5'. A connecting portion 42' extends upward from an upper end of the body portion 41, and the connecting portion 42' is offset from the connecting leg 5' in the lateral direction Y. A supporting portion 44 extends obliquely downward from one side of an upper end of the connecting portion 42' toward the groove 1341'. A gap exists between the supporting portion 44 and the connecting portion 42', such that the supporting portion 44 has a certain elasticity. The supporting portion 44 has a plain surface 442 located at a lower end thereof, and the plain surface 442 at least partially abuts the bearing portion 1342', such that the supporting portion 44 and the bearing portion 1342' form a pivot point P1'.

Figure 28:
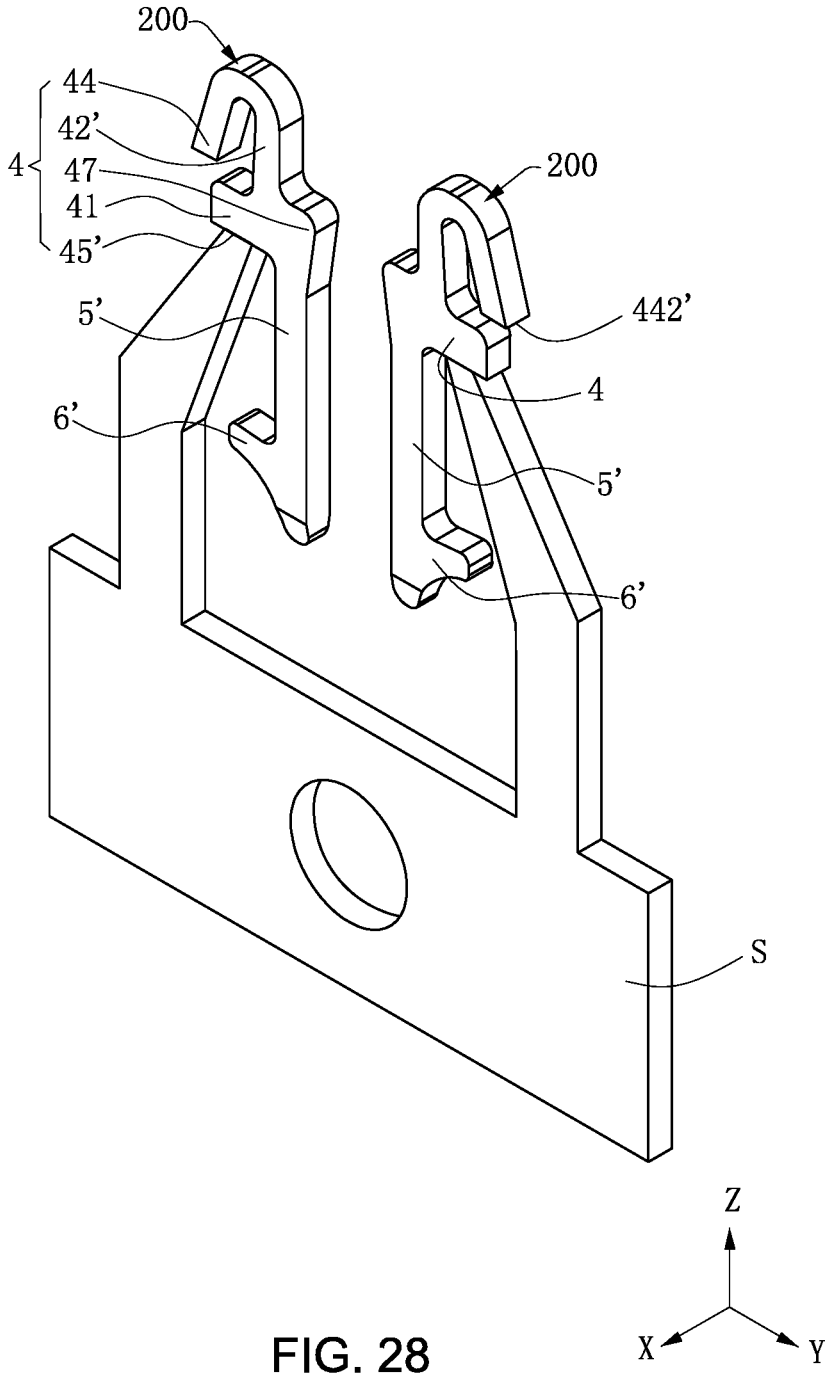
FIG. 28 is a perspective view of a buckle member in FIG. 24 before strip folding.
Figure 29:
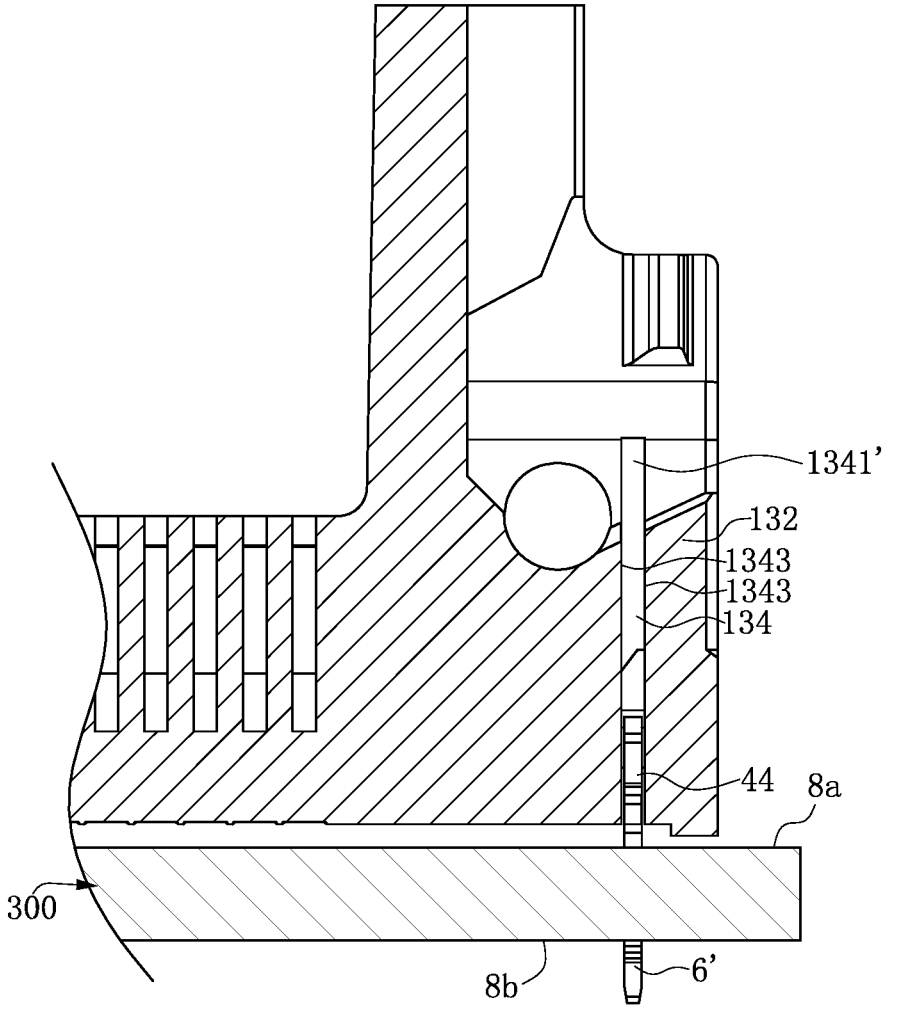
FIG. 29 is a partially sectional view of only an insulating body in FIG. 26 along an H-H direction with an ear clip being removed.

As shown in FIG. 27 and FIG. 28, in the present embodiment, a lower end of the body portion 41 is provided with a strip connecting portion 45' which is located at an inner side of the pivot point P1' close to the connecting leg 6', and the strip connecting portion 45' is located below the pivot point P1'. Before each buckle member 200 is mounted in the corresponding mounting slot 134, the two buckle members 200 corresponding to each of the mounting portions 13 are connected to the same strip S, and the two buckle members 200 are correspondingly assembled in the two adjacent mounting slots 134 upward from bottom thereof at the same time by the strip S.

As shown in FIG. 27 and FIG. 28, one side of the body portion 41 is provided with a protruding block 47. The protruding block 47 and the strip connecting portion 45' are located at opposite sides of the connecting leg 6' in the lateral direction Y. The protruding block 47 protrudes toward the corresponding partition barrier 135, and a protruding tail end of the protruding block 47 is configured to be arc-shaped.

As shown in FIG. 24 to FIG. 27, in the present embodiment, in the process of mounting the buckle member 200 in the through hole 8*c*, the buckle portion 6' is subject to a downward force of the circuit board 300, and swings outward from the through hole 8*c* in the lateral direction Y around the pivot point P1'. That is, the buckle point P2' moves toward the pivot point P1' in the lateral direction Y, such the buckle portion 6' is fastened to the circuit board 300. At this time, the protruding block 47 may abut a side surface of the partition barrier 135 to prevent the buckle portion 6' from swinging outward from the corresponding through hole 8*c* excessively such that the supporting portion 44 is detached from the bearing portion 1342', thus avoiding the buckle member 200 from being detached downward from the mounting slot 134. Both the connecting portion 42' and the supporting portion 44 are limited by the stopper 1344' to prevent the buckle member 200 from moving upward excessively.

To sum up, the assembly device according to certain embodiments of the present invention has the following beneficial effects:

1) Each buckle member 200 is provided with the extending portion 5 in the gap J between the bottom of the electrical connector 100 and the circuit board 300, and each mounting slot 134 is provided with the position limiting portion 1341 to stop the buckle member 200 from being detached downward from the mounting slot 134. That is, the electrical connector 100 cannot be detached upward from the buckle member 200, such that the base 4 of the buckle member 200 is mounted to the mounting slot 134, and the through hole 8*c* is sleeved outside the connecting leg 6 and the circuit board 300 upward abuts the extending portion 5. Since the extending portion 5 extends obliquely downward from the base 4, there is necessarily an included angle α between the extending portion 5 and the bottom of the electrical connector 100. The included angle α may be reduced due to the upward abutting force applied to the extending portion 5 by the circuit board 300, so as to drive the connecting leg 6 to rotationally swing toward one side away from the partition barrier 135. Since the extending portion 5 and the buckle portion 7 are located at the same side of the connecting leg 6 in the lateral direction Y, the buckle portion 7 can also rotationally swing toward one side away from the partition barrier 135 along with the extending portion 5, such that the buckle portion 7 can be effectively provided below the bottom surface 8*b* of the circuit board 300 to stop the buckle portion 7 from moving upward. That is, the buckle portion 7 may be used for stopping the circuit board 300 from moving downward. It can be seen that the upward abutting force applied to the extending portion 5 by the circuit board 300 may effectively ensure the buckle member 200 to be capable of rotationally swinging, thus providing the buckle portion 7 below the bottom surface 8*b* of the circuit board 300 to stop the circuit board 300 from moving downward. Moreover, the electrical connector 100 cannot be detached upward from the buckle member 200.

2) Since the position limiting portion 1341 and the stopping portion 1351 are located at two opposite sides of the body portion 41 in the lateral direction Y, and the body portion 41 is stopped by the position limiting portion 1341 in the lateral direction Y, the protruding portion 42 provided away from the extending portion 5 is stopped by the stopping portion 1351 in the lateral direction Y, such that the buckle member 200 is respectively stopped by the position limiting portion 1341 and the stopping portion 1351 located at the two opposite sides of the body portion 41 in the lateral direction Y, thereby limiting the buckle member 200 to be movable only between the position limiting portion 1341 and the stopping portion 1351 in the lateral direction Y.

3) Since the blocking portion 1342 and the position limiting portion 1341 are located at the upper and lower sides of the connecting portion 43 in the vertical direction Z, and the turning portion 433 in the connecting portion 43 is stopped by the blocking portion 1342 in the vertical direction Z, the supporting portion 44 provided at the tail end of the connecting portion 43 is stopped by the position limiting portion 1341 in the vertical direction Z, such that the buckle member 200 is respectively stopped by the blocking portion 1342 and the position limiting portion 1341 located at the opposite sides of the connecting portion 43 in the vertical direction Z, thereby limiting the buckle member 200 to be movable only between the blocking portion 1342 and the position limiting portion 1341 in the vertical direction Z.

4) The protruding portion 42 extends upward from the body portion 41 to abut the stopping portion 1351 in the lateral direction Y. The extending portion 5 extends obliquely downward toward a direction away from the protruding portion 42 from the body portion 41 in the lateral direction Y, and the extending portion 5 is provided below the position limiting portion 1341, such that when the circuit board 300 applies an upward abutting force to the extending portion 5, the protruding portion 42 is rotatable toward one side close to the partition barrier 135 in the lateral direction Y. Moreover, since an included angle formed between the extending direction of the protruding portion 42 and the extending direction of the extending portion 5 is an obtuse angle, the protruding block 42 can abut the stopping portion 1351 as soon as possible after the body portion 41 is rotatable between the position limiting portion 1341 and the stopping portion 1351 at a smaller angle.

5) Since the connecting portion 43 extends upward from the body portion 41, and then bends downward to be connected to the supporting portion 44, the connecting portion 43 is inverted U-shaped, allowing the supporting portion 44 to abut the position limiting portion 1341 downward from top thereof, and effectively preventing the buckle member 200 from being detached downward from the mounting slot 134. Moreover, the supporting portion 44 and the protruding portion 42 are provided at both sides of the connecting portion 43 respectively, and the protruding portion 42 and the connecting portion 43 are provided at an interval in the lateral direction Y. When the body portion 41 rotates toward one side away from the partition barrier 135 in the lateral direction Y, the supporting portion 44 can abut above the position limiting portion 1341, and when the body portion 41 rotates toward one side of the partition barrier 135 in the lateral direction Y, the protruding portion 42 can abut the stopping portion 1351.

6) Since the position limiting portion 1341 and the stopping portion 1351 are located at two opposite sides of the body portion 41 in the lateral direction Y, the connecting portion 43 and the protruding portion 42 extend upward from the body portion 41 respectively. Moreover, the connecting portion 43 is close to the position limiting portion 1341, and the protruding portion 42 is close to the stopping portion 1351. When the circuit board 300 abuts upward against the extending portion 5, the buckle member 200 can achieve at least one of the effects that the supporting portion 44 abuts the position limiting portion 1341 or the protruding portion 42 abuts the stopping portion 1351.

7) An included angle between the extending portion 5 and the connecting leg 6 is an acute angle, and an included angle between the buckle portion 7 and the connecting leg 6 is an acute angle. It can be seen that the extending direction of the extending portion 5 and the extending direction of the buckle portion 7 intersect with each other at the same side of the connecting leg 6, such that the extending portion 5 and the buckle portion 7 stop the circuit board 300 in the vertical direction Z by vertical limitation.

8) The buckle portion 7 extends obliquely downward from the connection leg 6. The included angle between the connecting leg 6 and the buckle portion 7 is an obtuse angle, and the protrusions 72 are provided along the extending direction of the buckle portion 7. The joint 8*d* of the bottom surface 8*b* of the circuit board 300 and the through hole 8*c* is engaged with one of the protrusions 72, such that when the circuit board 300 is subjected to a downward acting force, one of the protrusions 72 inevitably applies an upward stopping force to the circuit board 300 to prevent the circuit board 300 from moving downward, i.e., to stop the buckle portion 7 from moving upward.

9) The buckle member 200 is in loose fit with the electrical connector 100, such that the buckle member 200 is rotatable relative to the electrical connector 100, and the pivot point P1' is provided farther away from the corresponding through hole 8*c* than the buckle point P2' in the lateral direction Y. When the buckle portion 6' is subject to a downward force of the circuit board 300, the buckle portion 6' is pressed to swing outward from the through hole 8*c* in the lateral direction Y around the pivot point P1'. That is, the buckle point P2' moves toward the pivot point P1' in the lateral direction Y, such that the buckle portion 6' is fastened to the bottom surface 8*b* of the circuit board 300, thereby firmly fastening the circuit board 300, preventing the buckle member 200 from being detached from the circuit board 300, and enhancing the buckle effect between the buckle member 200 and the circuit board 300.

10) The connecting legs 5' of the two adjacent buckle members 200 at one end of the insertion slot 12 are received in the same through hole 8*c*, and the two buckle portions 6' corresponding to the same through hole 8*c* face away from each other in the lateral direction Y and fasten the circuit board 300 upward, thereby enhancing the buckle effect between the buckle member 200 and the circuit board 300.

11) The elastic sheet 43' is located below the stopper 1344', preventing the buckle member 200 from being detached upward from the electrical connector 100. The bearing portion 1342' achieves a supporting function while the buckle member 200 is limited from being detached downward from the electrical connector 100, and the mounting effect between the buckle member 200 and the electrical connector 100 is enhanced.

12) When the buckle member 200 is mounted in the through hole 8*c*, the buckle member 200 is subject to an upward force of the circuit board 300. At this time, since the flange 1345 abuts the stop portion 46, the buckle member 200 uses the flange 1345 as a supporting part, and rotates in the electrical connector 100 around the flange 1345, thereby ensuring the buckle effect between the buckle member 200 and the circuit board 300.

13) In the process of mounting the buckle member 200 in the through hole 8*c*, the buckle portion 6' is subject to a downward force of the circuit board 300, and the buckle portion 6' swings outward from the corresponding through hole 8*c* in the lateral direction Y around the pivot point P1'. At this time, the protruding block 47 may abut a side surface of the partition barrier 135 to prevent the buckle portion 6' from swinging outward from the through hole 8*c* excessively, thus avoiding the supporting portion 44 from being detached from the bearing portion 1342', and avoiding the buckle member 200 from being detached downward from the mounting slot 134.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical assembly device, comprising:

a first device having a housing, provided with a mounting slot penetrating through a bottom of the first device, wherein the mounting slot is provided with a position limiting portion on a side wall of the first device;

a second device, having a through hole penetrating vertically therethrough, wherein the second device is provided below the first device, and a gap is formed between the second device and the bottom of the first device in a vertical direction; and a buckle member, configured to connect the first device and the second device, wherein the buckle member is correspondingly accommodated in the mounting slot, and the buckle member comprises:

a base, provided in the mounting slot and extending to the side wall;

a connecting leg extending downward from the base, wherein the connecting leg is inserted downward into the through hole and is provided with a buckle portion extending in a lateral direction outward from the through hole; and an extending portion, provided in the gap and formed by extending obliquely downward from the base, wherein the extending portion and the buckle portion are located at a same side of the connecting leg in the lateral direction;

wherein the position limiting portion is configured to stop the buckle member from being detached downward from the mounting slot, and the second device upward abuts the extending portion to drive the buckle portion to swing outward from the through hole, such that the second device is located above the buckle portion to stop the buckle portion from moving upward; and wherein the buckle portion is provided with a first abutting point configured to abut the second device, the extending portion is provided with a second abutting point configured to abut the second device, the base is provided with a third abutting point configured to abut a slot wall of the mounting slot, and the first abutting point is located between the second abutting point and the third abutting point in the lateral direction.

2. The electrical assembly device according to claim 1, wherein the base comprises a supporting portion located above the position limiting portion, the supporting portion is configured to downward abut the position limiting portion before the buckle member is connected to the second device, so as to prevent the buckle member from being detached downward from the mounting slot, and the extending portion and the supporting portion are respectively provided at an upper side and a lower side of the position limiting portion.

3. The electrical assembly device according to claim 2, wherein the supporting portion is detached from the position limiting portion after the buckle member is connected to the second device, and is provided separately from the position limiting portion.

4. The electrical assembly device according to claim 1, wherein the base is provided with a fourth abutting point configured to abut the position limiting portion, and the fourth abutting point is located between the first abutting point and the second abutting point in the lateral direction.

5. The assembly device according to claim 1, wherein the slot wall of the mounting slot is provided with a stopping portion, the base comprises a body portion and a protruding portion extending from the body portion, the extending portion is formed by extending from the body portion, the protruding portion and the extending portion are respectively located at two opposite sides of the body portion in the lateral direction, and the protruding portion is stopped by the stopping portion in the lateral direction.

6. The assembly device according to claim 5, wherein the protruding portion is formed by extending upward from the body portion, the extending portion is formed by extending from the body portion in the lateral direction toward a direction away from the protruding portion, and an included angle formed between an extending direction of the protruding portion and an extending direction of the extending portion is an obtuse angle.

7. The assembly device according to claim 5, wherein the base comprises a connecting portion and a supporting portion, the connecting portion extends upward from the body portion and then bends downward to be connected to the supporting portion, the supporting portion is located above the position limiting portion and is limited by the position limiting portion to prevent the buckle member from being detached downward from the mounting slot, and the supporting portion and the protruding portion are respectively provided at two sides of the connecting portion.

8. The assembly device according to claim 5, wherein the stopping portion abuts the protruding portion such that an abutting position of the extending portion and the second device moves in the lateral direction toward a direction away from the corresponding through hole.

9. The assembly device according to claim 1, wherein the buckle portion is provided to extend obliquely downward from the connecting leg, an included angle between the connecting leg and the buckle portion is an obtuse angle, the buckle portion is provided with a plurality of protrusions along an extending direction of the buckle portion, and a joint between a bottom of the second device and the through hole is engaged with one of the protrusions.

10. The assembly device according to claim 1, comprising two buckle members, wherein the first device is provided with two adjacent mounting slots and a partition barrier separating the two adjacent mounting slots, each of the mounting slots accommodates one of the two buckle members, the buckle members in the adjacent mounting slots are inserted into the same through hole, and the extending portions of the two buckle members inserted into the same through hole extend toward opposite directions in the lateral direction.

11. The electrical assembly device according to claim 10, wherein each of the buckle members is provided with a strip connecting portion at a lower end of the buckle portion thereof, and the strip connecting portions of the two adjacent buckle members are configured to be connected to a same strip.

* * * * *